US011008903B2

(12) United States Patent
Mitsutani

(10) Patent No.: US 11,008,903 B2
(45) Date of Patent: May 18, 2021

(54) VALVE TIMING ADJUSTMENT DEVICE

(71) Applicant: DENSO CORPORATION, Kariya (JP)

(72) Inventor: Tetsuro Mitsutani, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/555,122

(22) Filed: Aug. 29, 2019

(65) Prior Publication Data

US 2019/0383178 A1 Dec. 19, 2019

Related U.S. Application Data

(63) Continuation of application No. PCT/JP2018/015928, filed on Apr. 18, 2018.

(30) Foreign Application Priority Data

Apr. 21, 2017 (JP) ..... JP2017-084387

(51) Int. Cl.
*F01L 1/344* (2006.01)

(52) U.S. Cl.
CPC ... *F01L 1/3442* (2013.01); *F01L 2001/34426* (2013.01); *F01L 2001/34483* (2013.01); *F01L 2250/06* (2013.01)

(58) Field of Classification Search
CPC ..... F01L 1/3442; F01L 2001/34426; F01L 2001/34483; F01L 2250/06; F01L 2001/34469; F01L 2001/3444; F01L 2001/34456; F01L 2001/3443; F01L 2001/34433; F01L 2250/02; F01L 2250/04; F01L 2001/34423
USPC ..... 123/90.17, 90.15, 90.12
See application file for complete search history.

(56) References Cited

U.S. PATENT DOCUMENTS 6,763,791 B2 7/2004 Gardner et al.
6,899,126 B2 * 5/2005 Weigand ..... F01L 1/34 137/512.15
7,836,857 B2 * 11/2010 Knecht ..... F01L 1/34409 123/90.12

(Continued)

FOREIGN PATENT DOCUMENTS

CN 110199093 A 9/2019
DE 102014103400 B3 * 6/2015 ..... F01L 1/3442

(Continued)

OTHER PUBLICATIONS

U.S. Appl. No. 16/502,333 of Mitsutani, filed Jul. 3, 2019 (57 pages).

(Continued)

*Primary Examiner* — Patrick Hamo
*Assistant Examiner* — Wesley G Harris
(74) *Attorney, Agent, or Firm* — Nixon & Vanderhye P.C.

(57) ABSTRACT

A retard supply check valve is installed in a retard supply passage and is located on a side of a hydraulic oil controller where a hydraulic oil supply source is placed. The retard supply check valve enables only a flow of hydraulic oil from the hydraulic oil supply source toward a retard chamber. An advance supply check valve is installed in an advance supply passage and is located on the side of the hydraulic oil controller where the hydraulic oil supply source is placed. The advance supply check valve enables only a flow of the hydraulic oil from the hydraulic oil supply source toward an advance chamber.

16 Claims, 19 Drawing Sheets

(56) References Cited

U.S. PATENT DOCUMENTS

| | | | | |
|---|---|---|---|---|
| 7,845,321 | B2 * | 12/2010 | Kobaishi | F01L 1/022 123/90.17 |
| 7,987,827 | B2 * | 8/2011 | Fujiyoshi | F01L 1/34409 123/90.17 |
| 9,194,506 | B2 * | 11/2015 | Hutzelmann | F16K 17/105 |
| 9,366,162 | B1 * | 6/2016 | Haltiner, Jr. | F04C 2/3448 |
| 9,453,438 | B2 * | 9/2016 | Ikuma | F01L 1/3442 |
| 2002/0088413 | A1 * | 7/2002 | Smith | F01L 1/3442 123/90.15 |
| 2007/0119402 | A1 * | 5/2007 | Lancefield | F16D 3/10 123/90.17 |
| 2008/0060471 | A1 * | 3/2008 | Takahashi | F01L 1/3442 74/568 R |
| 2011/0247576 | A1 * | 10/2011 | Knecht | F01L 1/3442 123/90.17 |
| 2014/0311333 | A1 * | 10/2014 | Hutzelmann | F01L 1/3442 91/418 |
| 2017/0058726 | A1 | 3/2017 | Smith et al. | |
| 2019/0323388 | A1 | 10/2019 | Mitsutani | |
| 2019/0323392 | A1 | 10/2019 | Mitsutani | |
| 2019/0368387 | A1 | 12/2019 | Mitsutani | |

FOREIGN PATENT DOCUMENTS

| | | |
|---|---|---|
| JP | 2015-135058 | 7/2015 |
| JP | 2016-130467 | 7/2016 |
| WO | 2018/135573 | 7/2018 |
| WO | 2018/135577 | 7/2018 |
| WO | 2018/135584 | 7/2018 |
| WO | 2018/135586 | 7/2018 |
| WO | 2018/164022 | 9/2018 |

OTHER PUBLICATIONS

U.S. Appl. No. 16/502,361 of Mitsutani, filed Jul. 3, 2019 (52 pages).

U.S. Appl. No. 16/502,376 of Mitsutani, filed Jul. 3, 2019 (35 pages).

U.S. Appl. No. 16/502,404 of Mitsutani, et al. filed Jul. 3, 2019 (100 pages).

U.S. Appl. No. 16/542,460 of Mitsutani, filed Aug. 16, 2019 (66 pages).

* cited by examiner

VALVE TIMING ADJUSTMENT DEVICE

CROSS REFERENCE TO RELATED APPLICATIONS

This application is a continuation application of International Patent Application No. PCT/JP2018/015928 filed on Apr. 18, 2018, which designated the U.S. and claims the benefit of priority from Japanese Patent Application No. 2017-84387 filed on Apr. 21, 2017. The entire disclosures of all of the above applications are incorporated herein by reference.

TECHNICAL FIELD

The present disclosure relates to a valve timing adjustment device.

BACKGROUND

There is known a valve timing adjustment device that is installed in a drive force transmission path for transmitting a drive force from a drive shaft to a driven shaft of an internal combustion engine and adjusts a valve timing of valves that are driven to open and close by the driven shaft. In a case where the valve timing adjustment device is a hydraulic type, the valve timing adjustment device includes: a housing that is rotated synchronously with one of the drive shaft and the driven shaft; and a vane rotor that is fixed to an end portion of the other one of the drive shaft and the driven shaft. The valve timing adjustment device rotates the vane rotor in an retarding direction or an advancing direction by supplying hydraulic oil to one of a retard chamber and an advance chamber defined by the vane rotor in the inside of the housing. The hydraulic oil, which is supplied to the retard chamber and the advance chamber, is controlled by a hydraulic oil control valve.

SUMMARY

According to the present disclosure, there is provided a valve timing adjustment device configured to adjust a valve timing of a valve of an internal combustion engine. The valve timing adjustment device includes a retard supply check valve and an advance supply check valve. The retard supply check valve is installed in a retard supply passage and is located on a side of a hydraulic oil controller where a hydraulic oil supply source is placed. The retard supply check valve enables only a flow of hydraulic oil from the hydraulic oil supply source toward a retard chamber. The advance supply check valve is installed in an advance supply passage and is located on the side of the hydraulic oil controller where the hydraulic oil supply source is placed. The advance supply check valve enables only a flow of the hydraulic oil from the hydraulic oil supply source toward an advance chamber.

BRIEF DESCRIPTION OF DRAWINGS

The present disclosure, together with additional objectives, features and advantages thereof, will be best understood from the following description in view of the accompanying drawings.

DETAILED DESCRIPTION

Figure 1:
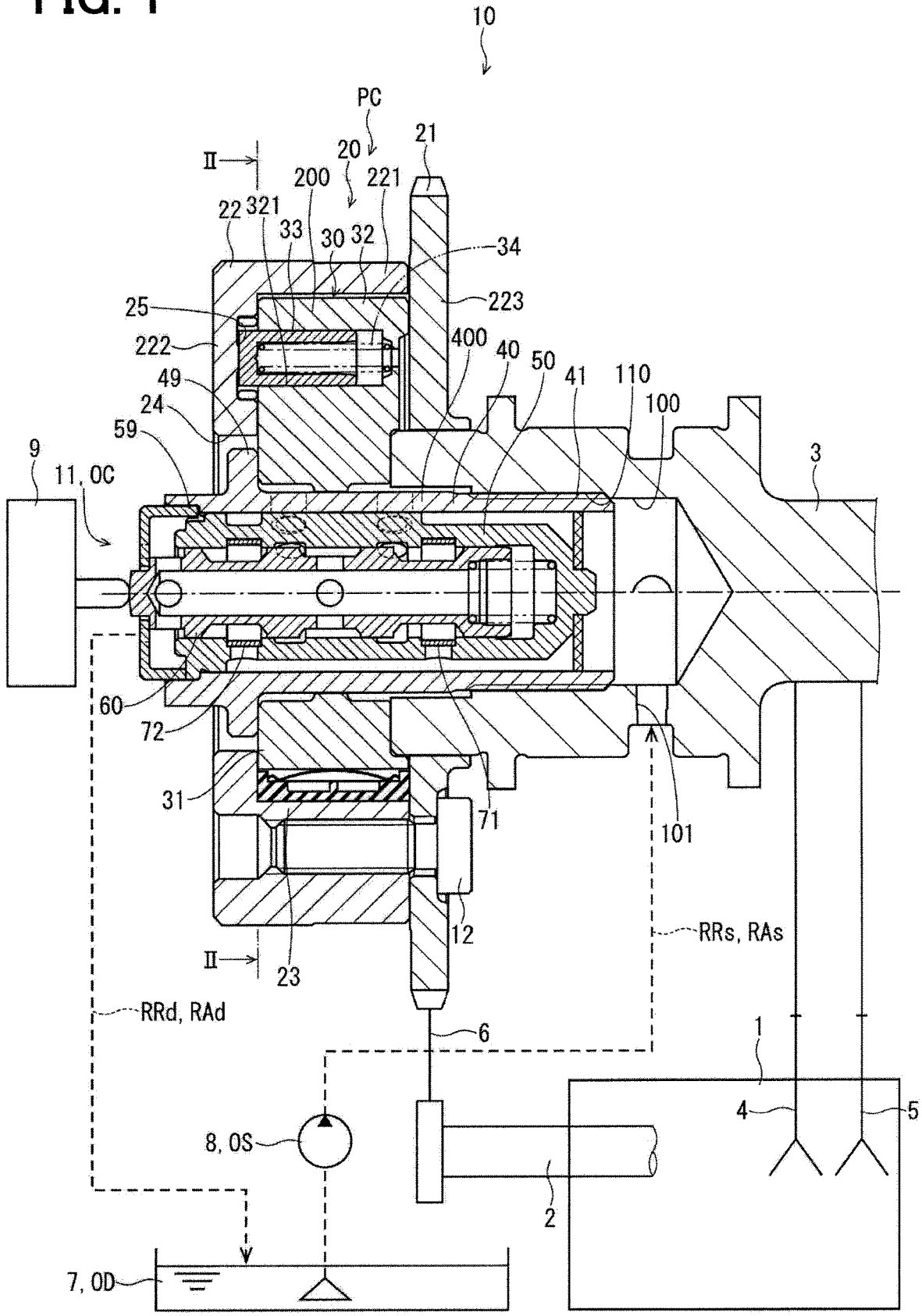
FIG. 1 is a cross-sectional view illustrating a valve timing adjustment device according to a first embodiment.

For example, in a previously proposed valve timing adjustment device, two check valves are placed on a downstream side of a hydraulic oil control valve, i.e., one of the two check valves is placed between the hydraulic oil control valve and a retard chamber, and the other one of the check vales is placed between the hydraulic oil control valve and an advance chamber. These check valves limit a back flow of hydraulic oil toward an upstream side, so that the hydraulic oil can be supplied to the retard chamber and the advance chamber even in a state where a phase of a vane rotor relative to a housing is maintained. However, in the previously proposed valve timing adjustment device, the two check valves are provided, i.e., the one of the two check valves is placed between the hydraulic oil control valve and the retard chamber, and the other one of the check vales is placed between the hydraulic oil control valve and the advance chamber. Therefore, the oil paths, which communicate the hydraulic oil control valve to the retard chamber and the advance chamber, need four systems, i.e., two systems for the retard chamber and two systems for the advance chamber. Because of this reason, the hydraulic oil control valve needs to have four openings, i.e., two openings communicated with the retard chamber and two openings communicated with the advance chamber. As a result, a size of the hydraulic oil control valve may possibly be increased in a direction, along which these four openings are axially arranged one after the other along the hydraulic oil control valve.

According to the present disclosure, there is provided a valve timing adjustment device configured to adjust a valve timing of a valve of an internal combustion engine. The valve timing adjustment device includes a phase converter, a hydraulic oil supply source, a hydraulic oil controller, an oil discharge portion, a retard supply passage, an advance supply passage, a drain passage, a retard supply check valve and an advance supply check valve.

The phase converter has a retard chamber and an advance chamber.

The hydraulic oil supply source is configured to supply hydraulic oil to the retard chamber and the advance chamber.

The hydraulic oil controller is configured to control the hydraulic oil supplied from the hydraulic oil supply source to the retard chamber and the advance chamber.

The oil discharge portion is configured to receive the hydraulic oil discharged from the retard chamber or the advance chamber.

The retard supply passage connects between the hydraulic oil supply source and the retard chamber through the hydraulic oil controller.

The advance supply passage connects between the hydraulic oil supply source and the advance chamber through the hydraulic oil controller.

The drain passage connects the retard chamber and the advance chamber to the oil discharge portion.

The retard supply check valve is installed in the retard supply passage and is located on a side of the hydraulic oil controller where the hydraulic oil supply source is placed. The retard supply check valve enables only a flow of the hydraulic oil from the hydraulic oil supply source toward the retard chamber.

The advance supply check valve is installed in the advance supply passage and is located on the side of the hydraulic oil controller where the hydraulic oil supply source is placed. The advance supply check valve enables only a flow of the hydraulic oil from the hydraulic oil supply source toward the advance chamber.

In the present disclosure, the retard supply check valve and the advance supply check valve are installed at the retard side and the advance side, respectively, so that the back flow of the hydraulic oil toward the hydraulic oil supply source is limited, and the hydraulic oil can be supplied to the retard chamber and the advance chamber even in the state where the phase of the phase converter is maintained. Specifically, at the time of maintaining the current phase of the phase converter, it is possible to maintain the supply state of the hydraulic oil to the retard chamber and the advance chamber to limit phase fluctuations of the phase converter, which would be caused by the air drawn into the retard chamber and the advance chamber.

Furthermore, in the present embodiment, the retard supply check valve and the advance supply check valve are placed on the upstream side of the hydraulic oil controller. Therefore, the oil paths on the downstream side of the hydraulic oil controller, i.e., the oil paths between the hydraulic oil controller and the retard and advance chambers can be integrated into two systems, i.e., one system for the retard chamber and one system for the advance chamber. Thus, the openings formed at the hydraulic oil controller for the retard chamber and the advance chamber can be limited to two axial locations, i.e., one axial location where the opening communicated with the retard chamber is provided, and another axial location where the opening communicated with the advance chamber is provided. In this way, the size of the hydraulic oil controller can be reduced in the direction, along which these openings are axially arranged one after the other along the hydraulic oil controller.

Hereinafter, a valve timing adjustment device according to a plurality of embodiments of the present disclosure will be described with reference to the drawings. Components that are substantially the same in the plurality of embodiments are denoted by the same reference signs and will not be described redundantly. Moreover, components that are substantially the same in the plurality of embodiments exert the same or similar effects.

First Embodiment

Figure 2:
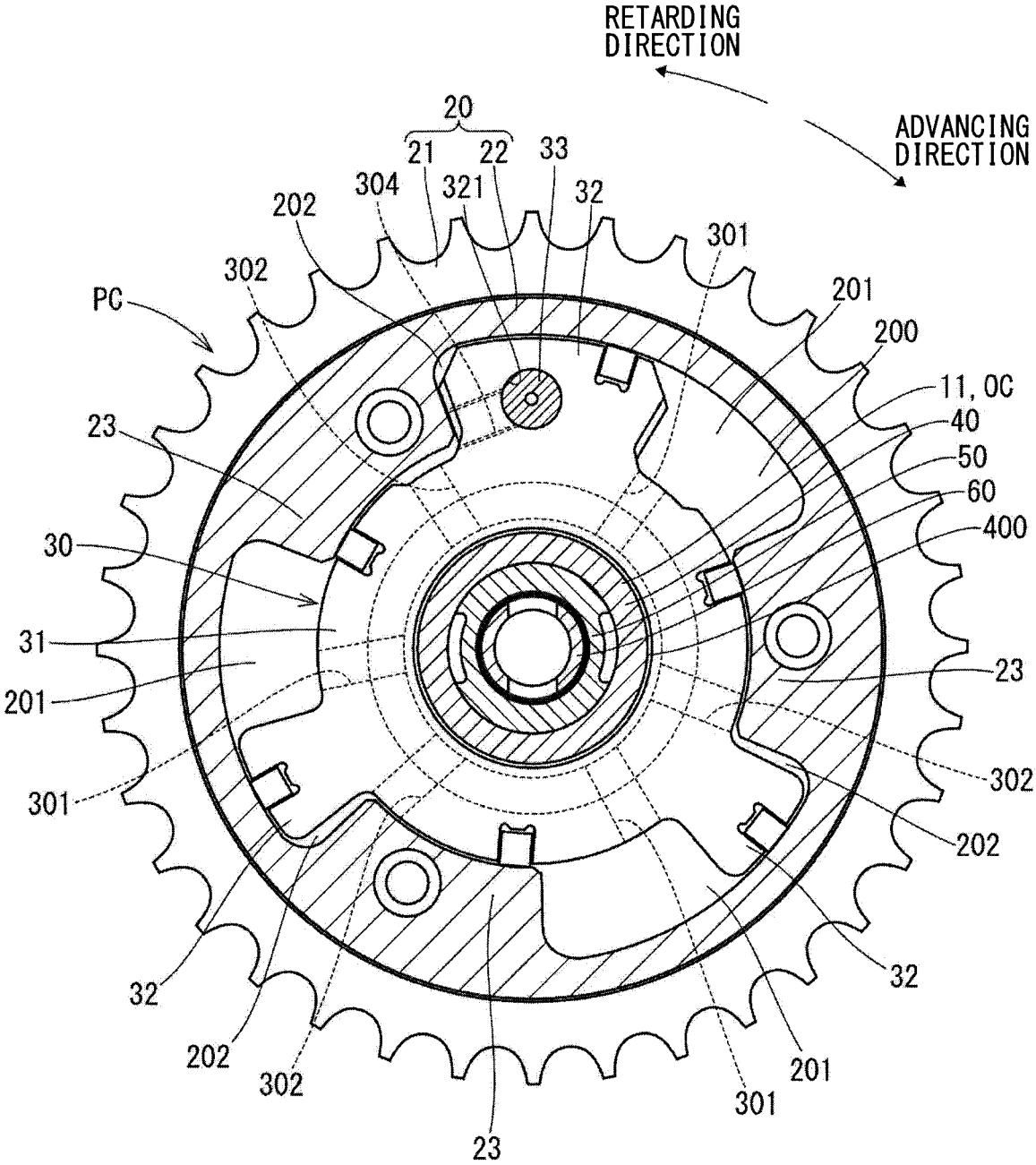
FIG. 2 is a cross-sectional view taken along line II-II in FIG. 1.

FIGS. 1 and 2 illustrate a valve timing adjustment device according to a first embodiment. The valve timing adjustment device 10 changes a rotational phase of a camshaft 3 relative to a crankshaft 2 of an engine 1 (serving as an internal combustion engine), so that the valve timing adjustment device 10 adjusts a valve timing of intake valves 4 among the intake valves 4 and exhaust valves 5 driven to open and close by the camshaft 3. The valve timing adjustment device 10 is installed in a drive force transmission path that extends from the crankshaft 2 to the camshaft 3. The crankshaft 2 corresponds to a drive shaft. The camshaft 3 corresponds to a driven shaft. The intake valves 4 and the exhaust valves 5 correspond to valves.

The structure of the valve timing adjustment device 10 will be described with reference to FIGS. 1 and 2.

The valve timing adjustment device 10 includes a phase converter PC, a hydraulic oil supply source OS, a hydraulic oil controller OC, an oil discharge portion OD, a retard supply passage RRs, an advance supply passage RAs, a retard drain passage RRd, an advance drain passage RAd (the drain passages RRd, RAd serving as drain passages), a retard supply check valve 71 and an advance supply check valve 72.

The phase converter PC has a housing 20 and a vane rotor 30.

The housing 20 has a gear portion 21 and a case 22. The case 22 has a tubular portion 221 and plate portions 222, 223. The tubular portion 221 is shaped in a tubular form. The plate portion 222 is integrally formed with the tubular portion 221 such that the plate portion 222 closes one end of the tubular portion 221. The plate portion 223 is formed to close the other end of the tubular portion 221. In this way, a space 200 is formed in an inside of the housing 20. The plate portion 223 is fixed to the tubular portion 221 by bolts 12. The gear portion 21 is formed at an outer periphery of the plate portion 223.

The plate portion 223 is fitted to an end portion of the camshaft 3. The camshaft 3 rotatably supports the housing 20. A chain 6 is wound around the gear portion 21 and the crankshaft 2. The gear portion 21 is rotated synchronously with the crankshaft 2.

The case 22 forms a plurality of partition wall portions 23 that inwardly project from the tubular portion 221 in the radial direction. An opening 24 is formed at a center of the plate portion 222 of the case 22 such that the opening 24 opens to a space, which is located at the outside of the case 22. The opening 24 is located on an opposite side of the vane rotor 30, which is opposite to the camshaft 3.

The vane rotor 30 has a boss 31 and a plurality of vanes 32. The boss 31 is shaped in a tubular form and is fixed to the end portion of the camshaft 3. Each of the vanes 32 outwardly projects from the boss 31 in the radial direction and is placed between corresponding adjacent two of the partition wall portions 23. The space 200, which is formed in the inside of the housing 20, is divided into retard chambers 201 and advance chambers 202 by the vanes 32. That is, the housing 20 forms the retard chambers 201 and the advance chambers 202 between the housing 20 and the vane rotor 30. Each retard chamber 201 is positioned on one circumferential side of the corresponding vane 32. Each advance chamber 202 is positioned on the other circumferential side of the corresponding vane 32. The vane rotor 30 rotates relative to the housing 20 in a retarding direction or an advancing direction according to an oil pressure in the respective retard chambers 201 and an oil pressure in the respective advance chambers 202.

In the present embodiment, the hydraulic oil controller OC is a hydraulic oil control valve 11. The hydraulic oil control valve 11 includes a sleeve 400 and a spool 60.

In the present embodiment, the hydraulic oil control valve 11 is placed at the center part of the housing 20 and the vane rotor 30 (see FIGS. 1 and 2). In other words, the hydraulic oil control valve 11 is placed such that at least a portion of the hydraulic oil control valve 11 is located in the inside of the housing 20.

The sleeve 400 has an outer sleeve 40 and an inner sleeve 50.

The outer sleeve 40 is shaped in a substantially cylindrical tubular form and is made of a material, which includes, for example, iron and has a relatively high hardness. An inner peripheral wall of the outer sleeve 40 is shaped in a substantially cylindrical form.

Figure 3:
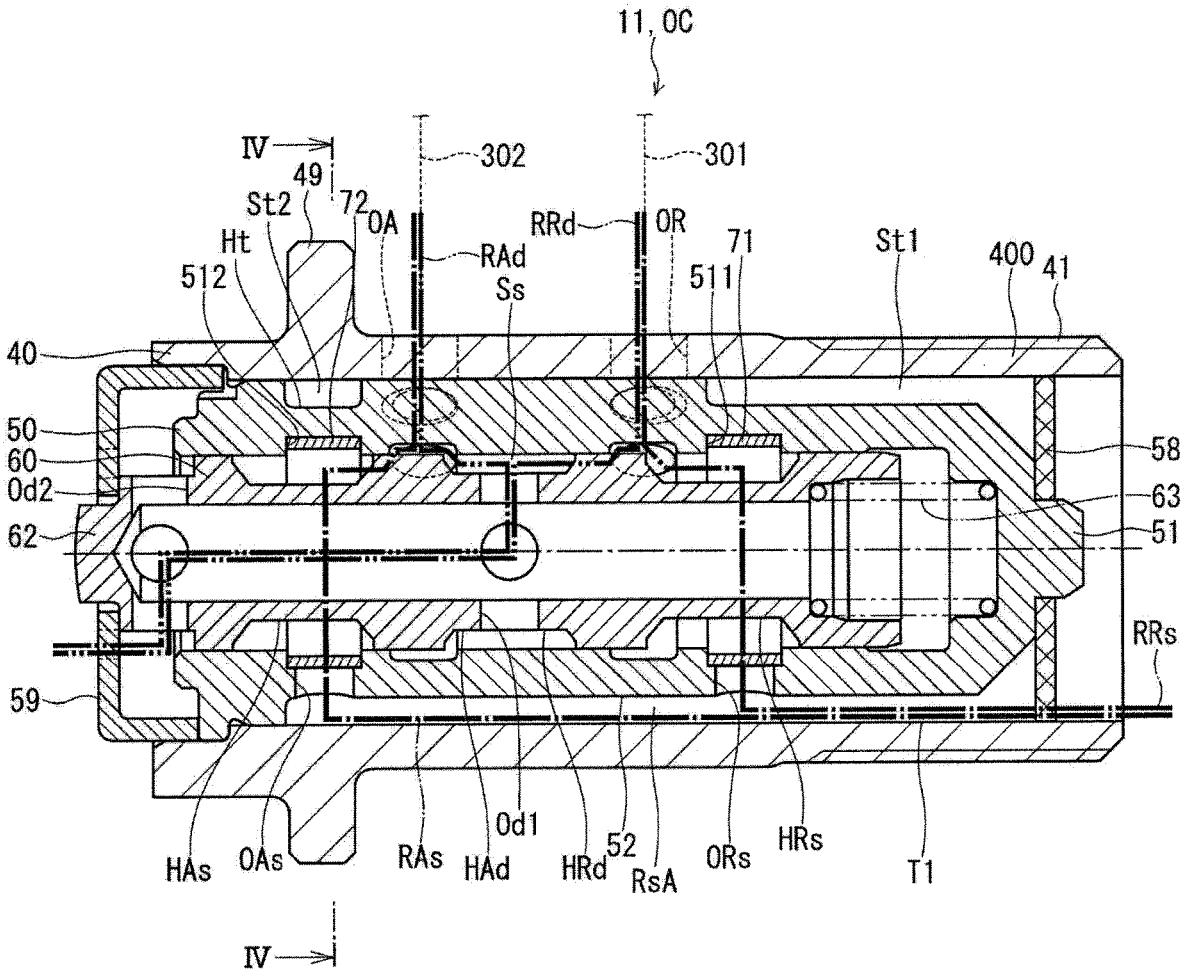
FIG. 3 is a cross-sectional view illustrating a hydraulic oil control valve of the valve timing adjustment device according to the first embodiment.

As illustrated in FIG. 3, a threaded portion 41 is formed at an outer peripheral wall of one end portion of the outer sleeve 40. A retaining portion 49 is formed at the other end portion of the outer sleeve 40 such that the retaining portion 49 is shaped in a ring form and outwardly extends from an outer peripheral wall of the other end portion of the outer sleeve 40 in the radial direction.

A shaft hole 100 and a plurality of supply holes 101 are formed at the end portion of the camshaft 3, which is located on the valve timing adjustment device 10 side. The shaft hole 100 is formed to extend in an axial direction of the camshaft 3 from a center part of an end surface of the camshaft 3, which is located on the valve timing adjustment device 10 side. Each of the supply holes 101 is formed such that the supply hole 101 inwardly extends from an outer wall of the camshaft 3 in the radial direction and is communicated with the shaft hole 100.

A shaft-side threaded portion 110 is formed at an inner wall of the shaft hole 100 of the camshaft 3 to threadably engage with the threaded portion 41 of the outer sleeve 40.

The outer sleeve 40 is inserted through the inside of the boss 31 of the vane rotor 30 and is fixed to the camshaft 3 such that the threaded portion 41 of the outer sleeve 40 is engaged with the shaft-side threaded portion 110 of the camshaft 3. At this time, the retaining portion 49 retains an end surface of the boss 31 of the vane rotor 30, which is opposite to the camshaft 3. In this way, the vane rotor 30 is fixed to the camshaft 3 such that the vane rotor 30 is held between the camshaft 3 and the retaining portion 49. The outer sleeve 40 is thus installed to the center of the vane rotor 30.

In the present embodiment, the hydraulic oil supply source OS is an oil pump 8. The oil discharge portion OD is an oil pan 7. The oil pump 8 is connected to the supply holes 101. The oil pump 8 suctions the hydraulic oil stored in the oil pan 7 and supplies the suctioned hydraulic oil to the supply holes 101. As a result, the hydraulic oil flows into the shaft hole 100.

The inner sleeve 50 is shaped in a substantially cylindrical tubular form and is made of a material, which includes, for example, aluminum and has a relatively low hardness. Specifically, the inner sleeve 50 is made of the material that has the hardness lower than the hardness of the outer sleeve 40. An inner peripheral wall and an outer peripheral wall of the inner sleeve 50 are respectively shaped in a substantially cylindrical form. The inner sleeve 50 is subjected to surface hardening using anodized aluminum or the like, so that a surface layer of the inner sleeve 50 has a hardness that is higher than a hardness of a base material of the inner sleeve 50.

As illustrated in FIG. 3, the inner sleeve 50 is placed at the inside of the outer sleeve 40 such that an outer peripheral wall of the inner sleeve 50 is fitted to the inner peripheral wall of the outer sleeve 40. The inner sleeve 50 is immovable relative to the outer sleeve 40.

A sleeve sealing portion 51 is formed at one end of the inner sleeve 50. The sleeve sealing portion 51 closes the one end of the inner sleeve 50.

The spool 60 is shaped in a substantially cylindrical tubular form and is made of, for example, metal.

The spool 60 is placed in an inside of the inner sleeve 50 such that an outer peripheral wall of the spool 60 is slidable along the inner peripheral wall of the inner sleeve 50 to enable reciprocation of the spool 60 in the axial direction.

A spool sealing portion 62 is formed at one end of the spool 60. The spool sealing portion 62 closes the one end of the spool 60.

A variable volume space Sv is formed between the sleeve sealing portion 51 and the other end of the spool 60 at the inside of the inner sleeve 50. A volume of the variable volume space Sv changes when the spool 60 is moved relative to the inner sleeve 50 in the axial direction. Specifically, the sleeve sealing portion 51 forms the variable volume space Sv, the volume of which changes, between the sleeve sealing portion 51 and the spool 60.

A spring 63 is installed in the variable volume space Sv. The spring 63 is a coil spring. One end of the spring 63 contacts the sleeve sealing portion 51, and other end of the spring 63 contacts the other end portion of the spool 60. The spring 63 urges the spool 60 in a direction away from the sleeve sealing portion 51.

A retaining portion 59 is placed on the radially inner side of the other end portion of the outer sleeve 40. The retaining portion 59 is shaped in a bottomed tubular form. An outer peripheral wall of the retaining portion 59 is fitted to the inner peripheral wall of the outer sleeve 40. A hole is formed at a center of a bottom of the retaining portion 59, and the spool sealing portion 62 is installed in an inside of this hole.

The bottom of the retaining portion 59 is configured to retain the one end of the spool 60. The retaining portion 59 can limit movement of the spool 60 toward a side that is opposite to the sleeve sealing portion 51. In this way, removal of the spool 60 from the inside of the inner sleeve 50 is limited.

The spool 60 is movable in the axial direction from a position, at which the spool 60 contacts the retaining portion 59, to a position, at which the spool 60 contacts the sleeve sealing portion 51. Specifically, a movable range of the spool 60 relative to the sleeve 400 extends from the position, at which the spool 60 contacts the retaining portion 59 (see FIGS. 3 and 6), to the position, at which the spool 60 contacts the sleeve sealing portion 51 (see FIG. 10). Hereinafter, the movable range of the spool 60 is referred to as a stroke range.

As illustrated in FIG. 3, the sleeve sealing portion 51 side end region of the inner sleeve 50 has an outer diameter that is smaller than an inner diameter of the outer sleeve 40. In this way, an annular space St1, which is shaped in a substantially annular form, is formed between an outer peripheral wall of the sleeve sealing portion 51 side end region of the inner sleeve 50 and the inner peripheral wall of the outer sleeve 40.

Moreover, an annular recess Ht is formed at the inner sleeve 50. The annular recess Ht, which is shaped in an annular form, is radially inwardly recessed at a portion of the outer peripheral wall of the inner sleeve 50, which corresponds to the retaining portion 49. In this way, an annular space St2, which is shaped in an annular form, is formed between the annular recess Ht and the inner peripheral wall of the outer sleeve 40.

A passage groove 52 is also formed at the inner sleeve 50. The passage groove 52 is radially inwardly recessed at the outer peripheral wall of the inner sleeve 50 and extends in the axial direction of the inner sleeve 50. The passage groove 52 forms an axial supply passage RsA. Specifically, the axial supply passage RsA is formed to extend in the axial direction of the sleeve 400 at an interface T1 between the outer sleeve 40 and the inner sleeve 50. One end of the axial supply passage RsA is connected to the annular space St1, and the other end of the axial supply passage RsA is connected to the annular space St2.

Limiting grooves 511, 512 are formed at the inner sleeve 50. The limiting groove 511, which is shaped in an annular form, is radially outwardly recessed at a portion of the inner peripheral wall of the inner sleeve 50, which corresponds to an end portion of the annular space St1. The limiting groove 512, which is shaped in an annular form, is radially outwardly recessed at a portion of the inner peripheral wall of the inner sleeve 50, which corresponds to the annular recess Ht.

The sleeve 400 has a plurality of retard supply openings ORs, a plurality of advance supply openings OAs, a plurality of retard openings OR and a plurality of advance openings OA.

Each retard supply opening ORs extends in the radial direction of the sleeve 400 and connects the limiting groove 511 of the inner sleeve 50 to the annular space St1 and the axial supply passage RsA. The plurality of retard supply openings ORs is arranged one after the other in the circumferential direction of the inner sleeve 50.

Each advance supply opening OAs extends in the radial direction of the sleeve 400 and connects the limiting groove 512 of the inner sleeve 50 to the annular space St2 and the axial supply passage RsA. The plurality of advance supply openings OAs is arranged one after the other in the circumferential direction of the inner sleeve 50.

Each retard opening OR extends in the radial direction of the sleeve 400 and connects the space, which is located at the inside of the inner sleeve 50, to the space, which is located at the outside of the outer sleeve 40. The plurality of the retard openings OR is arranged one after the other in the circumferential direction of the sleeve 400. Each retard opening OR is communicated with the corresponding retard chamber 201 through a corresponding retard passage 301.

Each advance opening OA extends in the radial direction of the sleeve 400 and connects the space, which is located at the inside of the inner sleeve 50, to the space, which is located at the outside of the outer sleeve 40. The advance opening OA is formed on the retaining portion 49 side of the retard openings OR. The plurality of the advance openings OA is arranged one after the other in the circumferential direction of the sleeve 400. Each advance opening OA is communicated with the corresponding advance chamber 202 through a corresponding advance passage 302.

The spool 60 has a retard supply recess HRs, a retard drain recess HRd, an advance drain recess HAd, an advance supply recess HAs, and a plurality of drain openings Od1, Od2.

The retard supply recess HRs, the retard drain recess HRd, the advance drain recess HAd and the advance supply recess HAs are respectively shaped in an annular form and radially inwardly recessed from the outer peripheral wall of the spool 60. The retard supply recess HRs, the retard drain recess HRd, the advance drain recess HAd and the advance supply recess HAs are arranged one after the other in this order in the axial direction of the spool 60. The retard drain recess HRd and the advance drain recess HAd are formed integrally. The retard drain recess HRd and the advance drain recess HAd form a specific space Ss relative to the inner peripheral wall of the inner sleeve 50. Specifically, the spool 60 forms the specific space Ss between the spool 60 and the sleeve 400.

Each drain opening Od1 communicates the space, which is located at the inside of the spool 60, to the retard drain recess HRd and the advance drain recess HAd, i.e., the specific space Ss. At the spool sealing portion 62 side end region of the spool 60, each drain opening Od2 communicates the space, which is located at the inside of the spool 60, to the space, which is located at the outside of the spool 60. The drain openings Od1 are arranged one after the other in the circumferential direction of the spool 60, and the drain openings Od2 are arranged one after the other in the circumferential direction of the spool 60.

The retard supply passage RRs connects the oil pump 8 to the retard chambers 201 through the hydraulic oil control valve 11. The advance supply passage RAs connects the oil pump 8 to the advance chambers 202 through the hydraulic oil control valve 11. The retard drain passage RRd, which serves as the drain passage, connects the retard chambers 201 to the oil pan 7. The advance drain passage RAd, which serves as the drain passage, connects the advance chambers 202 to the oil pan 7.

The retard supply passage RRs connects the oil pump 8 to the retard chambers 201 through the supply holes 101, the shaft hole 100, the annular space St1, the axial supply passage RsA, the retard supply openings ORs, the limiting groove 511, the retard supply recess HRs, the retard openings OR and the retard passages 301.

The advance supply passage RAs connects between the oil pump 8 and the advance chambers 202 through the supply holes 101, the shaft hole 100, the annular space St1, the axial supply passage RsA, the advance supply openings OAs, the limiting groove 512, the advance supply recess HAs, the advance openings OA, and the advance passages 302.

The retard drain passage RRd connects the retard chambers 201 to the oil pan 7 through the retard passages 301, the retard openings OR, the retard drain recess HRd and the drain openings Od1, Od2.

The advance drain passage RAd connects the advance chambers 202 to the oil pan 7 through the advance passages 302, the advance openings OA, the advance drain recess HAd and the drain openings Od1, Od2.

Thus, a portion of each of the retard supply passage RRs, the advance supply passage RAs, the retard drain passage RRd and the advance drain passage RAd is formed at the inside of the hydraulic oil control valve 11.

When the spool 60 is in contact with the retaining portion 59 (see FIGS. 3, 6, and 7), i.e., when the spool 60 is positioned at one end of the stroke range, the spool 60 opens the retard openings OR. Thereby, the oil pump 8 is communicated with the retard chambers 201 through the supply holes 101, the shaft hole 100, the annular space St1, the axial supply passage RsA, the retard supply openings ORs, the limiting groove 511, the retard supply recess HRs, the retard openings OR and the retard passages 301 of the retard supply passage RRs. As a result, the hydraulic oil can be supplied from the oil pump 8 to the retard chambers 201 through the retard supply passage RRs.

Moreover, at this time, the advance chambers 202 are communicated with the oil pan 7 through the advance passages 302, the advance openings OA, the advance drain recess HAd and the drain openings Od1, Od2 of the advance drain passage RAd. As a result, the hydraulic oil can be discharged from the advance chambers 202 to the oil pan 7 through the advance drain passage RAd.

When the spool 60 is positioned between the retaining portion 59 and the sleeve sealing portion 51 (see FIGS. 8 and 9), i.e., when the spool 60 is positioned in the middle of the stroke range, the oil pump 8 is communicated with the advance chambers 202 through the supply holes 101, the shaft hole 100, the annular space St1, the axial supply passage RsA, the advance supply openings OAs, the limiting groove 512, the advance supply recess HAs, the advance openings OA and the advance passages 302 of the advance supply passage RAs. At this time, the oil pump 8 is communicated with the retard chambers 201 through the retard supply passage RRs. As a result, the hydraulic oil can be supplied from the oil pump 8 to the retard chambers 201 and the advance chambers 202 through the retard supply passage RRs and the advance supply passage RAs. However, the retard drain passage RRd and the advance drain passage RAd are closed, i.e., are blocked by the spool 60. Therefore, the hydraulic oil is not discharged from the retard chambers 201 and the advance chambers 202 to the oil pan 7.

When the spool 60 is in contact with the sleeve sealing portion 51 (see FIGS. 10 and 11), i.e., when the spool 60 is positioned at the other end of the stroke range, the retard chambers 201 are communicated with the oil pan 7 through the retard passages 301, the retard openings OR, the retard drain recess HRd and the drain openings Od1, Od2 of the retard drain passage RRd. At this time, the oil pump 8 is communicated with the advance chambers 202 through the advance supply passage RAs. As a result, the hydraulic oil can be discharged from the retard chambers 201 to the oil pan 7 through the retard drain passage RRd, and the hydraulic oil can be supplied from the oil pump 8 to the advance chambers 202 through the advance supply passage RAs.

A filter 58 is installed at an inside of the sleeve sealing portion 51 side end region of the outer sleeve 40, i.e., the filter 58 is installed at the middle of the retard supply passage RRs and the advance supply passage RAs. The filter 58 is, for example, a mesh that is shaped in a circular disk form. The filter 58 can capture foreign objects contained in the hydraulic oil. Therefore, it is possible to limit flow of the foreign objects toward the downstream side of the filter 58, i.e., toward the side that is opposite from the oil pump 8.

Figure 5:
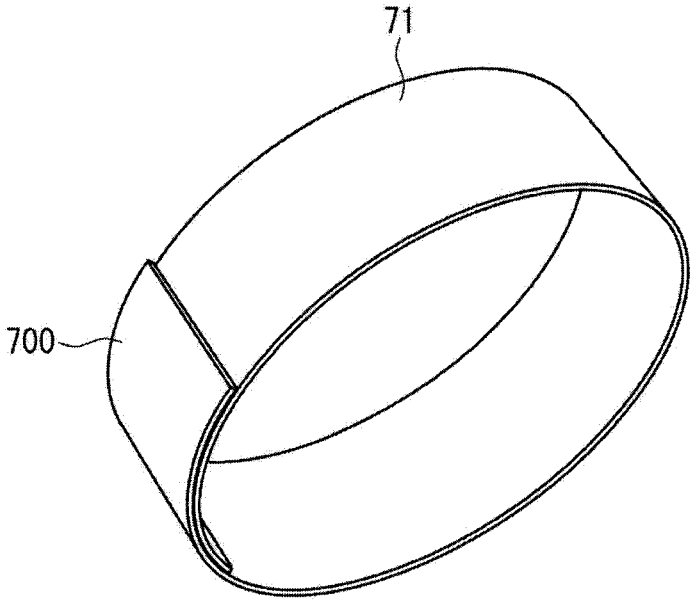
FIG. 5 is a perspective view illustrating a retard supply check valve of the valve timing adjustment device according to the first embodiment.

The retard supply check valve 71 is formed by rolling a rectangular metal thin plate such that a longitudinal direction of the rectangular metal thin plate coincides with the circumferential direction, so that the retard supply check valve 71 is shaped in a substantially cylindrical tubular form. FIG. 5 is a perspective view of the retard supply check valve 71.

The retard supply check valve 71 has an overlap portion 700.

The overlap portion 700 is formed at one circumferential end portion of the retard supply check valve 71. The overlap portion 700 is formed to overlap with a radially outer side of the other circumferential end portion of the retard supply check valve 71 (see FIG. 5).

The retard supply check valve 71 is installed in the limiting groove 511. The retard supply check valve 71 is installed such that the retard supply check valve 71 is resiliently deformable in the radial direction in the limiting groove 511. The retard supply check valve 71 is located on the radially inner side of the retard supply openings ORs in the radial direction of the inner sleeve 50. The retard supply check valve 71 is installed in the limiting groove 511 as follows. That is, in a state where the hydraulic oil does not flow in the retard supply passage RRs, i.e., in a state where an external force is not applied to the retard supply check valve 71, the overlap portion 700 overlaps with the other circumferential end portion of the retard supply check valve 71.

When the hydraulic oil flows from the retard supply opening ORs side toward the retard supply recess HRs in the retard supply passage RRs, the retard supply check valve 71 is deformed such that the outer peripheral wall of the retard supply check valve 71 is radially inwardly urged by the hydraulic oil and shrinks radially inward, i.e., an inner diameter of the retard supply check valve 71 is reduced. In this way, the outer peripheral wall of the retard supply check valve 71 is spaced away from the retard supply openings ORs, and thereby the hydraulic oil can flow toward the retard supply recess HRs through the retard supply check valve 71. At this time, the overlap portion 700 maintains a state in which a part of the overlap portion 700 overlaps with the other end portion of the retard supply check valve 71 while a length of the overlapping range, in which the overlap portion 700 overlaps with the other end portion of the retard supply check valve 71, is increased.

When the flow rate of the hydraulic oil flowing through the retard supply passage RRs becomes lower than or equal to a predetermined value, the retard supply check valve 71 is deformed to expand radially outward, i.e., the inner diameter of the retard supply check valve 71 is increased. When the hydraulic oil flows from the retard supply recess HRs side toward the retard supply openings ORs, the inner peripheral wall of the retard supply check valve 71 is radially outwardly urged by the hydraulic oil. Thereby, the retard supply check valve 71 contacts the retard supply openings ORs. In this way, the flow of the hydraulic oil from the retard supply recess HRs side toward the retard supply openings ORs is limited.

As discussed above, the retard supply check valve 71 functions as a check valve such that the retard supply check valve 71 enables the flow of the hydraulic oil from the retard supply opening ORs side toward the retard supply recess HRs and limits the flow of the hydraulic oil from the retard supply recess HRs side toward the retard supply openings ORs. Specifically, the retard supply check valve 71 is located on the oil pump 8 side of the spool 60 of the hydraulic oil control valve 11 in the retard supply passage RRs, and the retard supply check valve 71 enables only the flow of the hydraulic oil from the oil pump 8 side toward the retard chambers 201.

Similar to the retard supply check valve 71, the advance supply check valve 72 is formed by rolling a rectangular metal thin plate such that a longitudinal direction of the rectangular metal thin plate coincides with the circumferential direction, so that the advance supply check valve 72 is shaped in a substantially cylindrical tubular form. The structure of the advance supply check valve 72 is similar to that of the retard supply check valve 71 and thus will not be described in detail.

The advance supply check valve 72 is installed in the limiting groove 512. The advance supply check valve 72 is installed such that the advance supply check valve 72 is resiliently deformable in the radial direction in the limiting groove 512. The advance supply check valve 72 is located on the radially inner side of the advance supply openings OAs in the radial direction of the inner sleeve 50. The advance supply check valve 72 is installed in the limiting groove 512 as follows. That is, in a state where the hydraulic oil does not flow in the advance supply passage RAs, i.e., in a state where an external force is not applied to the advance supply check valve 72, the overlap portion 700 overlaps with the other circumferential end portion of the advance supply check valve 72.

When the hydraulic oil flows from the advance supply opening OAs side toward the advance supply recess HAs in the advance supply passage RAs, the advance supply check valve 72 is deformed such that the outer peripheral wall of the advance supply check valve 72 is radially inwardly urged by the hydraulic oil and shrinks radially inward, i.e., an inner diameter of the advance supply check valve 72 is reduced. In this way, the outer peripheral wall of the advance supply check valve 72 is spaced away from the advance supply openings OAs, and thereby the hydraulic oil can flow toward the advance supply recess HAs through the advance supply check valve 72. At this time, the overlap portion 700 maintains a state in which a part of the overlap portion 700 overlaps with the other end portion of the advance supply check valve 72 while a length of the overlapping range, in which the overlap portion 700 overlaps with the other end portion of the advance supply check valve 72, is increased.

When the flow rate of the hydraulic oil flowing through the advance supply passage RAs becomes lower than or equal to a predetermined value, the advance supply check valve 72 is deformed to expand radially outward, i.e., the inner diameter of the advance supply check valve 72 is increased. When the hydraulic oil flows from the advance supply recess HAs side toward the advance supply openings OAs, the inner peripheral wall of the advance supply check valve 72 is radially outwardly urged by the hydraulic oil. Thereby, the advance supply check valve 72 contacts the advance supply openings OAs. In this way, the flow of the hydraulic oil from the advance supply recess HAs side toward the advance supply openings OAs is limited.

As discussed above, the advance supply check valve 72 functions as a check valve such that the advance supply check valve 72 enables the flow of the hydraulic oil from the advance supply opening OAs side toward the advance supply recess HAs and limits the flow of the hydraulic oil from the advance supply recess HAs side toward the advance supply openings OAs. Specifically, the advance supply check valve 72 is located on the oil pump 8 side of the spool 60 of the hydraulic oil control valve 11 in the advance supply passage RAs, and the advance supply check valve 72 enables only the flow of the hydraulic oil from the oil pump 8 toward the advance chambers 202.

The limiting grooves 511, 512 can respectively limit axial movement of the retard supply check valve 71 and the axial movement of the advance supply check valve 72.

Figure 4:
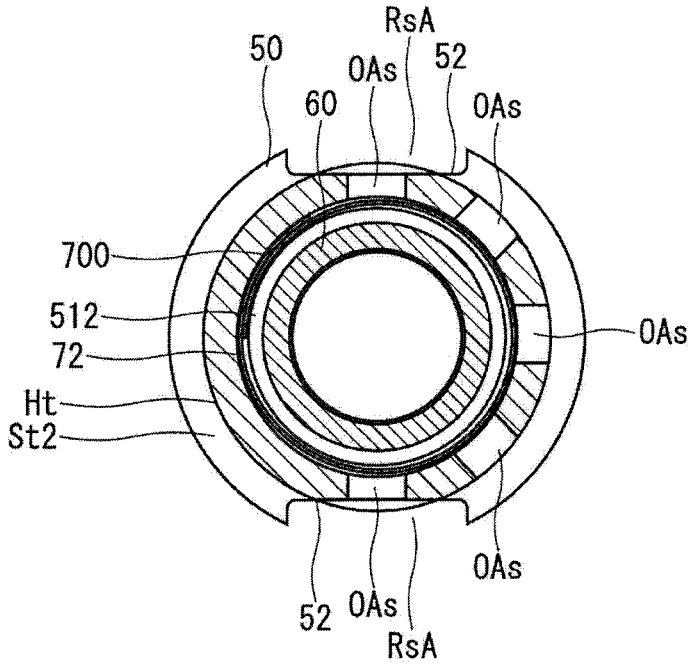
FIG. 4 is a cross-sectional view taken along line IV-IV in FIG. 3.

As illustrated in FIG. 4, the number of the advance supply openings OAs formed at the inner sleeve 50 is five. The advance supply openings OAs are formed in a range approximately half of the entire circumferential extent of the inner sleeve 50. That is, the advance supply openings OAs are localized only in a predetermined fraction of the circumferential extent of the inner sleeve 50. Thus, when the hydraulic oil flows from the advance supply openings OAs toward the advance supply recess HAs, the advance supply check valve 72 is urged by the hydraulic oil against the side of the limiting groove 512 that is diametrically opposite to the advance supply openings OAs. In this way, removal of the advance supply check valve 72 from the limiting groove 512 can be limited. The limiting groove 512 can thus maintain the function of limiting the axial movement of the advance supply check valve 72.

Like the advance supply openings OAs, the number of the retard supply openings ORs formed at the inner sleeve 50 is five. The retard supply openings ORs are formed in the range approximately half of the entire circumferential extent of the inner sleeve 50. That is, the retard supply openings ORs are localized only in the predetermined fraction of the circumferential extent of the inner sleeve 50. Thus, when the hydraulic oil flows from the retard supply openings ORs toward the retard supply recess HRs, the retard supply check valve 71 is urged by the hydraulic oil against the side of the limiting groove 511 that is diametrically opposite to the retard supply openings ORs. In this way, removal of the retard supply check valve 71 from the limiting groove 511 can be limited. The limiting groove 511 can thus maintain the function of limiting the axial movement of the retard supply check valve 71.

A linear solenoid 9 is located on the opposite side of the spool 60, which is opposite to the camshaft 3. The linear solenoid 9 is configured to contact the spool sealing portion 62. When the linear solenoid 9 is energized, the linear solenoid 9 urges the spool 60 toward the camshaft 3 through the spool sealing portion 62 against the urging force of the spring 63. As a result, the position of the spool 60 in the axial direction with respect to the sleeve 400 changes in the stroke range.

The variable volume space Sv is communicated with the retard drain passage RRd and the advance drain passage RAd. The variable volume space Sv is thus open to the atmosphere through the drain openings Od2 of the retard drain passage RRd and the advance drain passage RAd. As a result, the pressure in the variable volume space Sv can be made equal to the atmospheric pressure. This enables smooth movement of the spool 60 in the axial direction.

Next, a change in the flow of the hydraulic oil induced by a change in the position of the spool 60 relative to the sleeve 400 will be described with reference to FIGS. 6 to 12.

Figure 12:
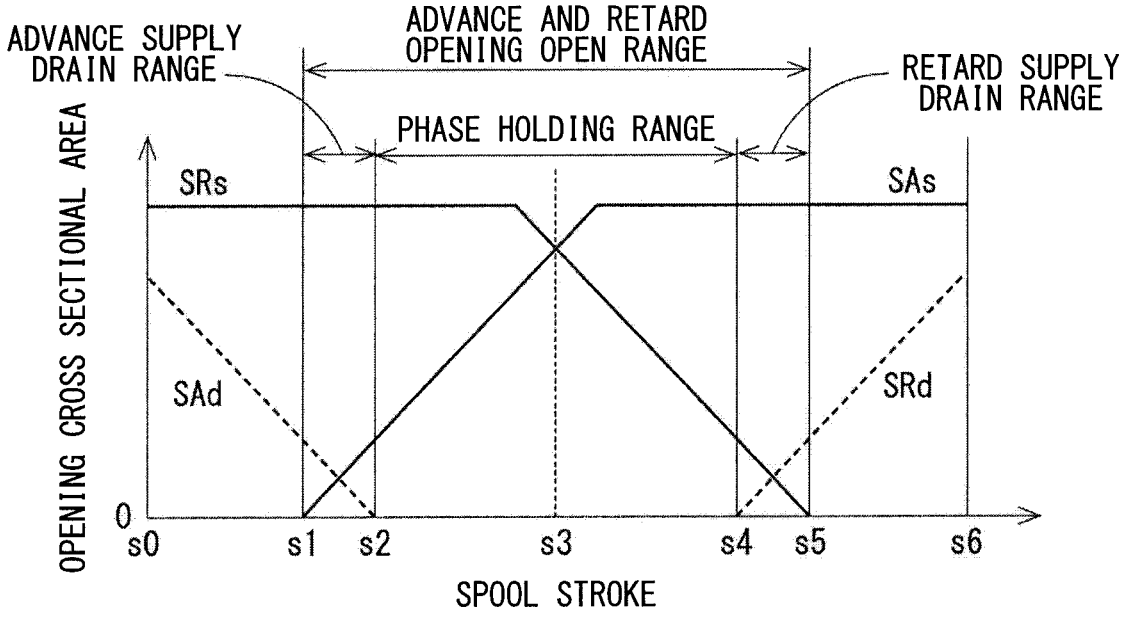
FIG. 12 is a diagram indicating a relationship between a position of the spool and an opening cross-sectional area of each corresponding passage at the valve timing adjustment device of the first embodiment.

In FIG. 12, a spool stroke, which is indicated at an axis of abscissas, corresponds to a distance of the spool 60 measured from the retaining portion 59. Values of the spool strokes s0, s1, s2, s3, s4, s5 and s6 indicated in FIG. 12 increase in this order. Here, the spool stroke s0 corresponds to the distance of the spool 60 in a state where the spool 60 contacts the retaining portion 59. The spool stroke s3 corresponds to the distance of the spool 60 in the state where the spool 60 is placed between the retaining portion 59 and the sleeve sealing portion 51. Furthermore, the spool stroke s6 corresponds to the distance of the spool 60 in the state where the spool 60 contacts the sleeve sealing portion 51. A range from the spool stroke s0 to the spool stroke s6 corresponds to the stroke range.

In FIG. 12, an opening cross-sectional area, which is indicated at an axis of ordinates, corresponds to an opening cross-sectional area of each corresponding passage. Here, the opening cross-sectional area refers to a minimum opening cross-sectional area of each corresponding passage, i.e., a flow passage cross-sectional area of the passage. In FIG. 12, reference sign SRs indicates the opening cross-sectional area of the retard supply passage RRs, and reference sign SAd indicates the opening cross-sectional area of the advance drain passage RAd. Furthermore, reference sign SAs indicates the opening cross-sectional area of the advance supply passage RAs, and reference sign SRd indicates the opening cross-sectional area of the retard drain passage RRd.

Figure 6:
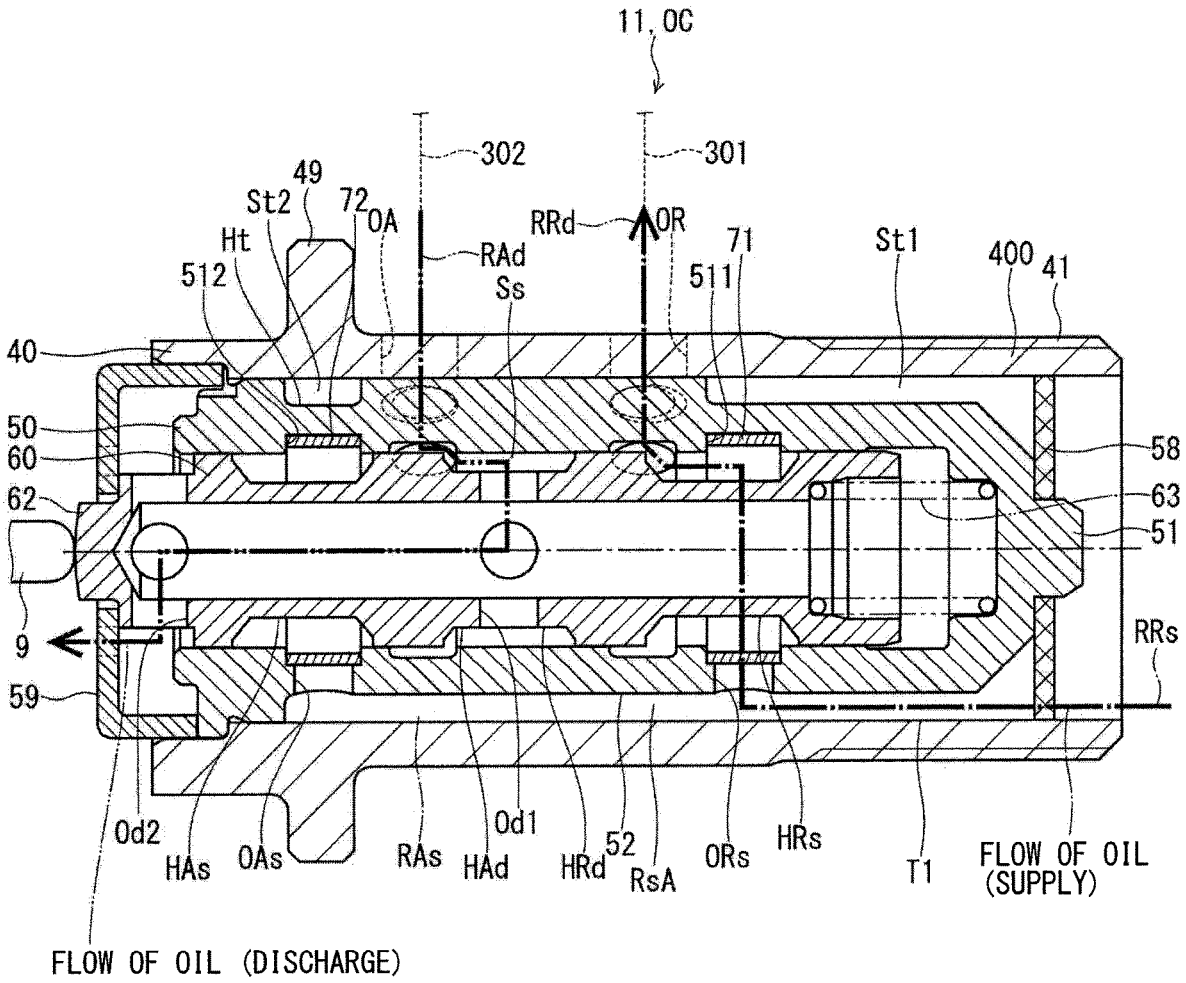
FIG. 6 is a cross-sectional view illustrating the hydraulic oil control valve of the valve timing adjustment device according to the first embodiment in a state where a spool is at one end of a stroke range.
Figure 7:
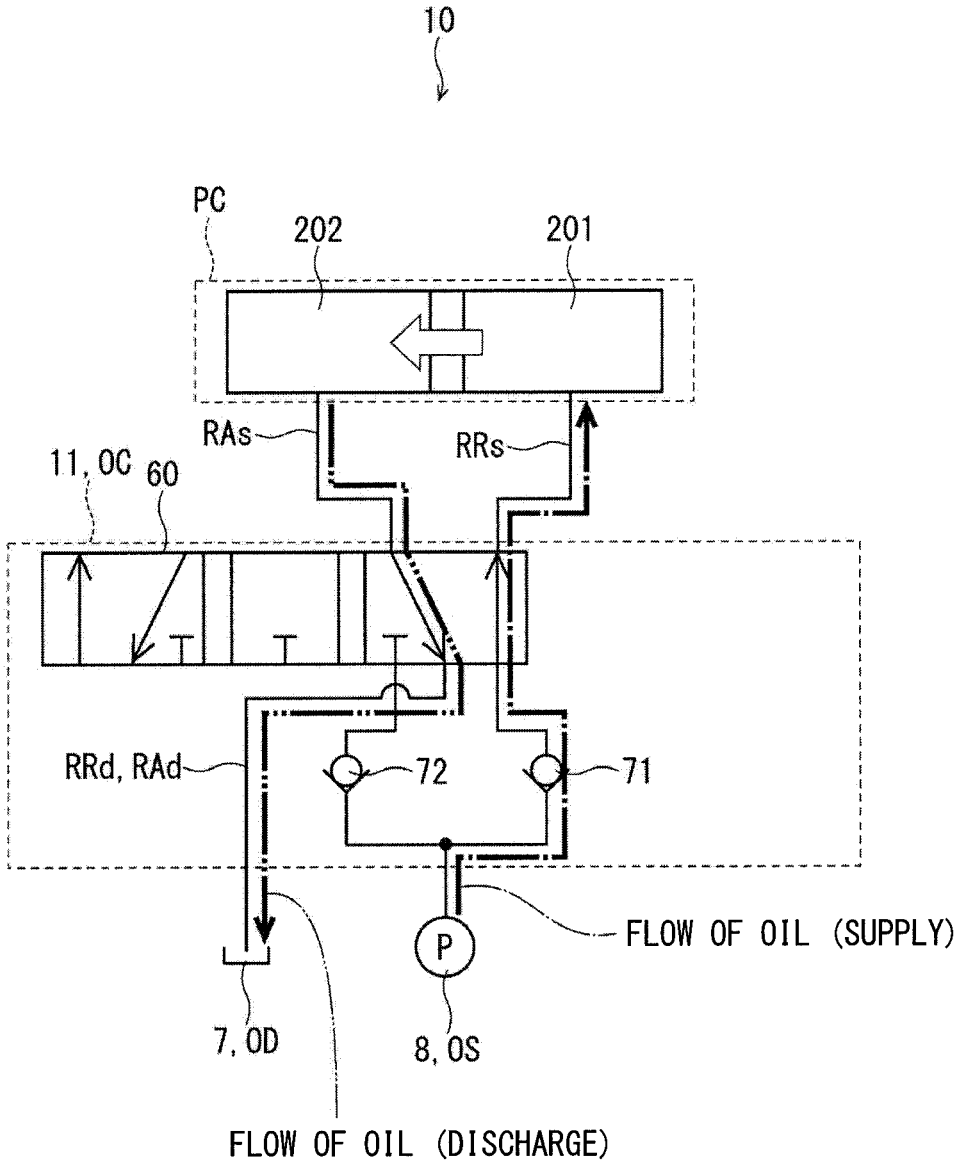
FIG. 7 is a schematic view illustrating the valve timing adjustment device according to the first embodiment in the state where the spool is at the one end of the stroke range.

As shown in FIGS. 6 and 7, when the spool 60 is in contact with the retaining portion 59, i.e., when the spool 60 is positioned at the one end of the stroke range (the stroke s0 in FIG. 12), the hydraulic oil is supplied from the oil pump 8 to the retard chambers 201 through the retard supply passage RRs. At this time, the hydraulic oil is discharged from the advance chambers 202 to the oil pan 7 through the advance drain passage RAd. At this time, the opening cross-sectional areas SRs, SAd, SAs, SRd respectively have corresponding values indicated at the spool stroke s0 in FIG. 12. Specifically, at this time, the opening cross-sectional area SRs is larger than zero, and the opening cross-sectional area SAd is larger than zero and is smaller than the opening cross-sectional area SRs. Furthermore, the opening cross-sectional area SAs and the opening cross-sectional area SRd are both zero.

Figure 8:
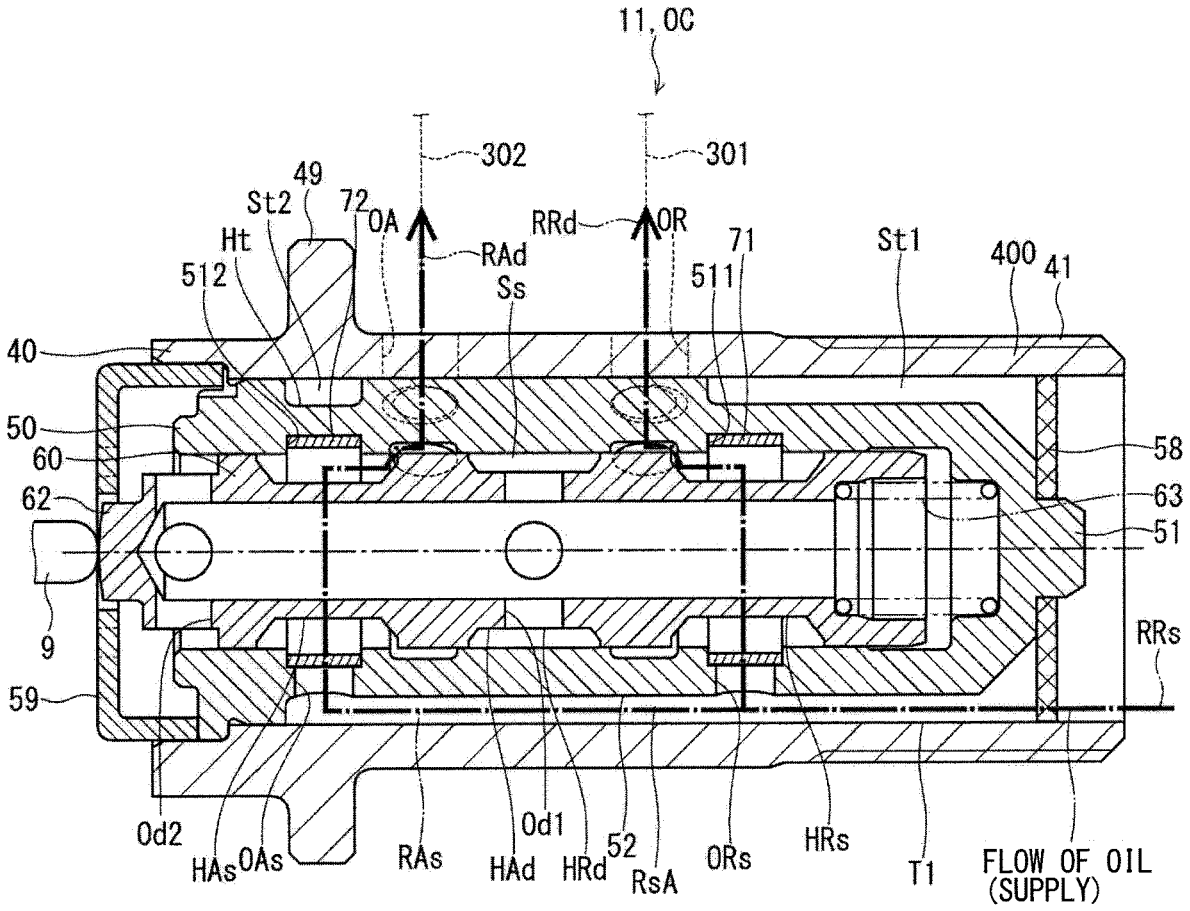
FIG. 8 is a cross-sectional view illustrating the hydraulic oil control valve of the valve timing adjustment device according to the first embodiment in a state where the spool is at an intermediate position of the stroke range.
Figure 9:
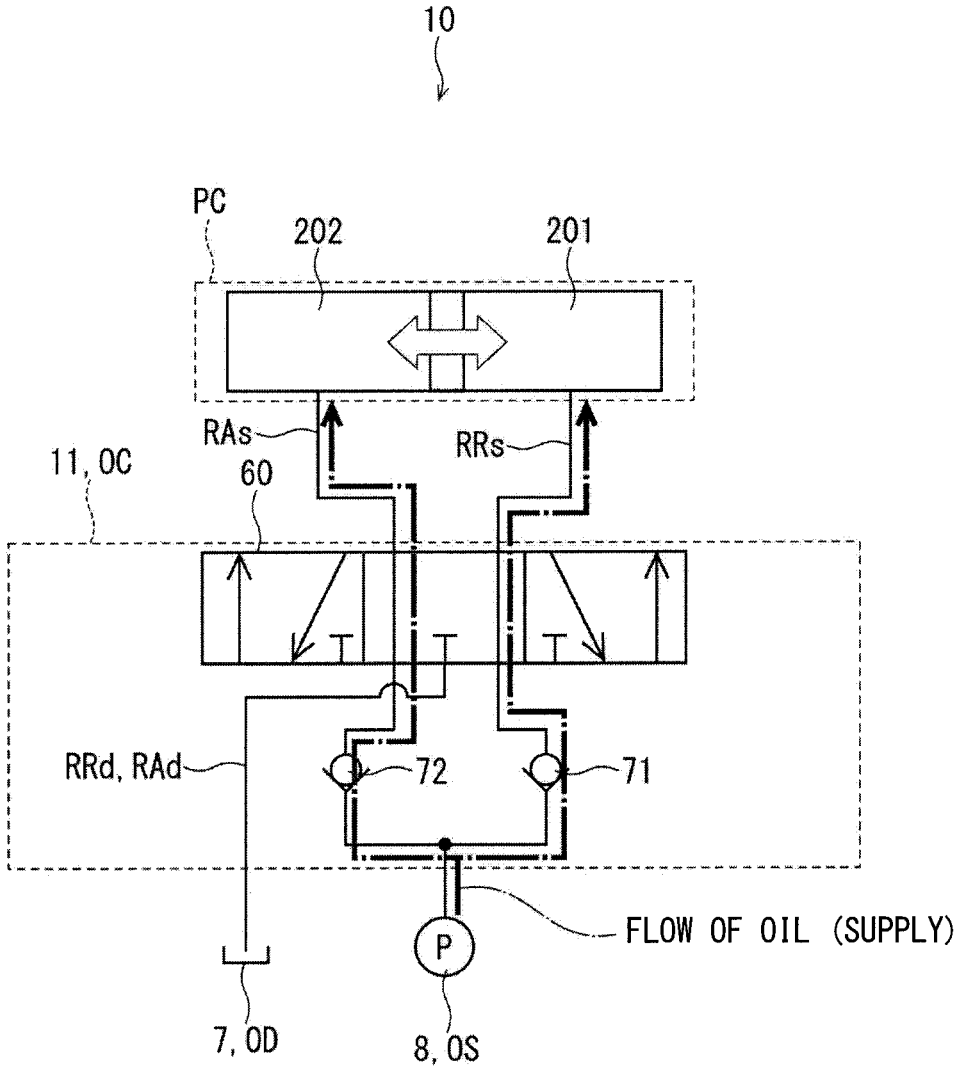
FIG. 9 is a schematic view illustrating the valve timing adjustment device according to the first embodiment in the state where the spool is at the intermediate position of the stroke range.

As shown in FIGS. 8 and 9, when the spool 60 is positioned between the retaining portion 59 and the sleeve sealing portion 51, i.e., when the spool 60 is positioned in the middle of the stroke range (the stroke s3 in FIG. 12), the hydraulic oil is supplied from the oil pump 8 to the retard chambers 201 through the retard supply passage RRs. At this time, the hydraulic oil is supplied from the oil pump 8 to the advance chambers 202 through the advance supply passage RAs. At this time, the opening cross-sectional areas SRs, SAd, SAs, SRd respectively have corresponding values indicated at the spool stroke s3 in FIG. 12. Specifically, at this time, the opening cross-sectional area SRs is larger than zero, and the opening cross-sectional area SAd is zero. Furthermore, the opening cross-sectional area SAs is larger than 0 (zero) and is equal to the opening cross-sectional area SRs, and the opening cross-sectional area SRd is zero.

Figure 10:
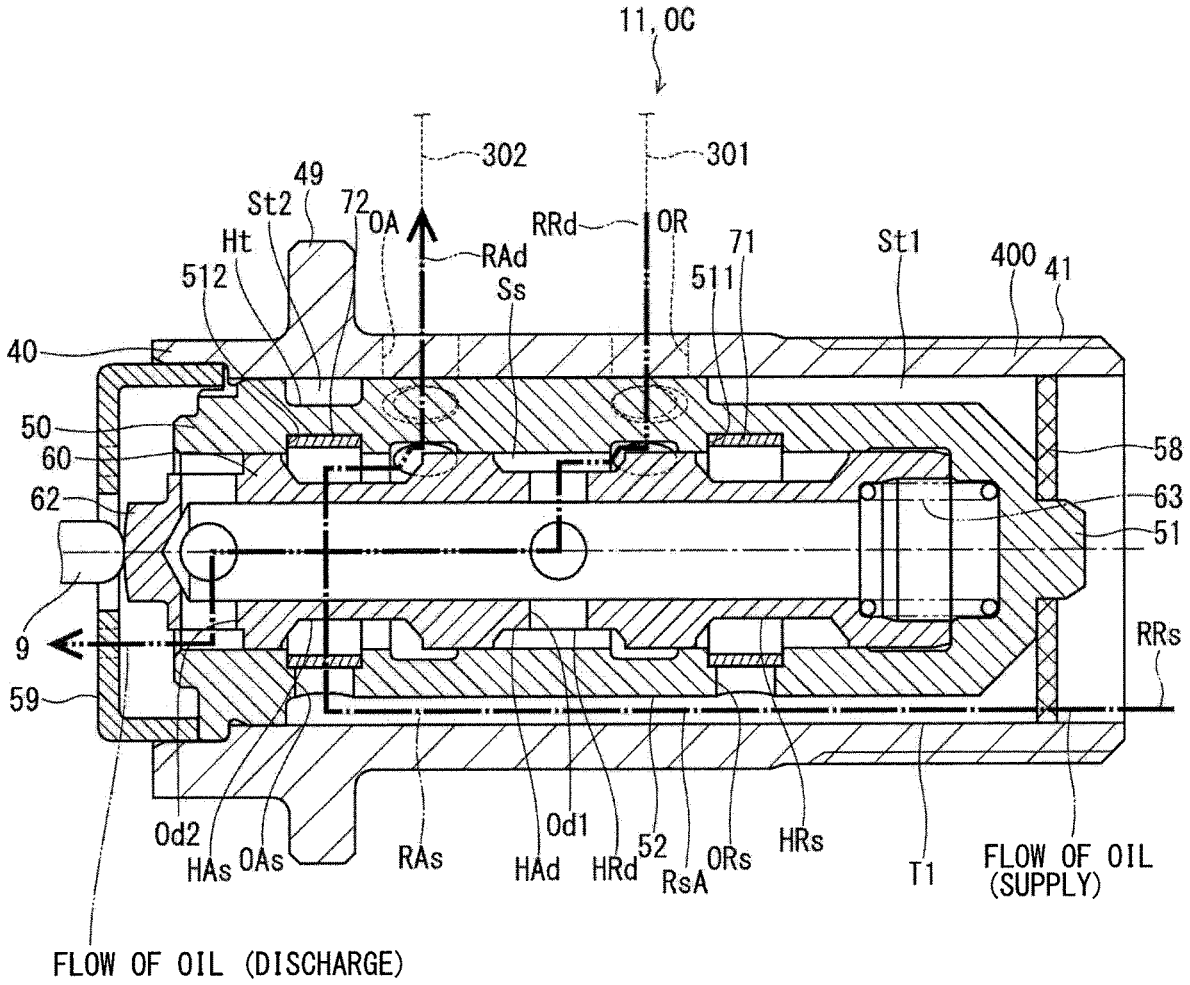
FIG. 10 is a cross-sectional view illustrating the hydraulic oil control valve of the valve timing adjustment device according to the first embodiment in a state where the spool is at the other end of the stroke range.
Figure 11:
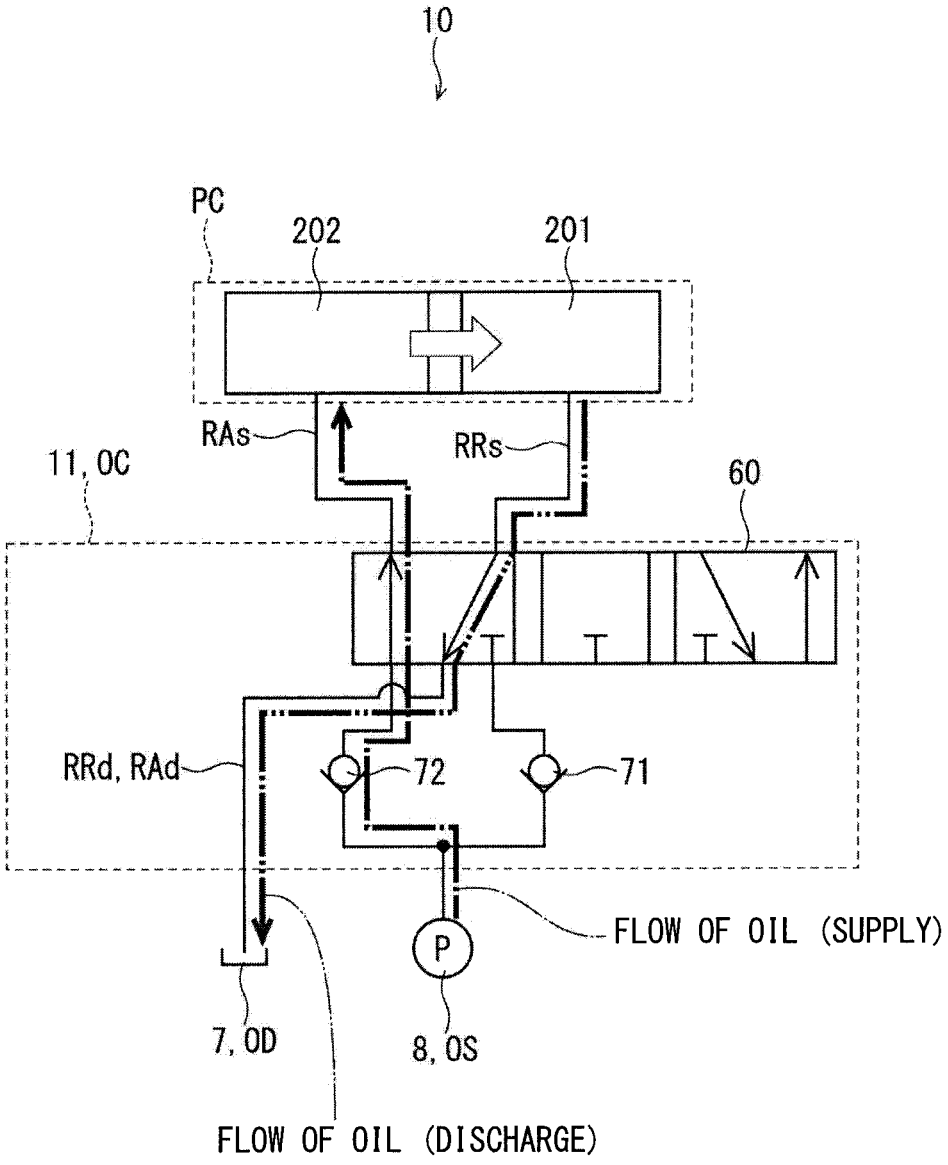
FIG. 11 is a schematic view illustrating the valve timing adjustment device according to the first embodiment in the state where the spool is at the other end of the stroke range.

As shown in FIGS. 10 and 11, when the spool 60 is in contact with the sleeve sealing portion 51, i.e., when the spool 60 is positioned at the other end of the stroke range (the stroke s6 in FIG. 12), the hydraulic oil is supplied from the oil pump 8 to the advance chambers 202 through the advance supply passage RAs. At this time, the hydraulic oil is discharged from the retard chambers 201 to the oil pan 7 through the retard drain passage RRd. At this time, the opening cross-sectional areas SRs, SAd, SAs, SRd respectively have corresponding values indicated at the spool stroke s6 in FIG. 12. Specifically, at this time, the opening cross-sectional area SRs and the opening cross-sectional area SAd are zero, and the opening cross-sectional area SAs is larger than zero. Furthermore, the opening cross-sectional area SRd is larger than zero and is smaller than the opening cross-sectional area SAs.

As shown in FIG. 12, in a range, which is from the spool stroke s2 to the spool stroke s4, the opening cross-sectional area SAd and the opening cross-sectional area SRd are zero. At this time, the spool 60 closes both of the retard drain passage RRd and the advance drain passage RAd to hold the phase of the phase converter PC. The stroke range of the spool 60 at this time is defined as a phase holding range.

Furthermore, in a range, which is from the spool stroke s1 to the spool stroke s5, the opening cross-sectional area SRs and the opening cross-sectional area SAs are larger than zero. At this time, the spool 60 opens both of the retard openings OR and the advance openings OA to enable the supply of the hydraulic oil to both of the retard chambers 201 and the advance chambers 202. The stroke range of the spool 60 at this time is defined as an advance and retard opening open range (an open range of the advance and retard openings).

Furthermore, in a range, which is from the spool stroke s1 to the spool stroke s2, the opening cross-sectional area SRs, the opening cross-sectional area SAd and the opening cross-sectional area SAs are larger than zero. At this time, the advance supply openings OAs are communicated with the advance drain passage RAd. The stroke range of the spool 60 at this time is defined as an advance supply drain range.

Furthermore, in a range, which is from the spool stroke s4 to the spool stroke s5, the opening cross-sectional area SRs, the opening cross-sectional area SRd and the opening cross-sectional area SAs are larger than zero. At this time, the retard supply openings ORs are communicated with the retard drain passage RRd. The stroke range of the spool 60 at this time is defined as a retard supply drain range.

As discussed above, in the present embodiment, the spool 60 has the stroke range (s0-s6) that is a range, in which the spool 60 is movable relative to the sleeve 400, while the stroke range (s0-s6) includes: the phase holding range (s2-s4), in which the spool 60 closes both of the retard drain passage RRd and the advance drain passage RAd and thereby holds the phase of the phase converter PC; and the advance and retard opening open range (s1-s5), in which the spool 60 opens both of the retard openings OR and the advance openings OA at least in the phase holding range.

The stroke range of the spool 60 includes: the advance supply drain range (s1-s2), in which the spool 60 communicates between the advance supply openings OAs and the advance drain passage RAd; and the retard supply drain range (s4-s5), in which the spool 60 communicates between the retard supply openings ORs and the retard drain passage RRd.

A length of the advance and retard opening open range (s1-s5) is set to be longer than a length of the phase holding range (s2-s4).

The present embodiment is further provided with a lock pin 33 (see FIGS. 1 and 2). The lock pin 33 is shaped in a bottomed cylindrical tubular form. The lock pin 33 is received in a receiving hole 321 formed at the vane 32 in such a manner that the lock pin 33 can axially reciprocate in the receiving hole 321. A spring 34 is installed in an inside of the lock pin 33. The spring 34 urges the lock pin 33 toward the plate portion 222 of the case 22. A fitting recess 25 is formed at the plate portion 222 of the case 22 on the vane 32 side of the plate portion 222.

The lock pin 33 can be fitted into the fitting recess 25 when the vane rotor 30 is held at a most retarded position with respect to the housing 20. When the lock pin 33 is fitted into the fitting recess 25, relative rotation of the vane rotor 30 relative to the housing 20 is limited. On the other hand, when the lock pin 33 is not fitted into the fitting recess 25, the relative rotation of the vane rotor 30 relative to the housing 20 is enabled.

A pin control passage 304, which is communicated with a corresponding one of the advance chambers 202, is formed in the vane 32 at a location between the lock pin 33 and the advance chamber 202 (see FIG. 2). The pressure of the hydraulic oil, which flows from the advance chamber 202 into the pin control passage 304, is exerted in a removing direction for removing the lock pin 33 from the fitting recess 25 against the urging force of the spring 34.

In the valve timing adjustment device 10 constructed in the above-described manner, when the hydraulic oil is supplied to the advance chambers 202, the hydraulic oil flows into the pin control passage 304. Thereby, the lock pin 33 is removed from the fitting recess 25, and thereby the relative rotation of the vane rotor 30 relative to the housing 20 is enabled.

Next, the operation of the valve timing adjustment device 10 will be described. The valve timing adjustment device 10 drives the hydraulic oil control valve 11 among a first operating state, a second operating state and a phase holding state when the linear solenoid 9 is driven to urge the spool 60 of the hydraulic oil control valve 11. In the first operating state of the hydraulic oil control valve 11, the oil pump 8 is connected to the retard chambers 201, and the advance chambers 202 are connected to the oil pan 7. In the second operating state of the hydraulic oil control valve 11, the oil pump 8 is connected to the advance chambers 202, and the retard chambers 201 are connected to the oil pan 7. In the phase holding state of the hydraulic oil control valve 11, the oil pump 8 is connected to the retard chambers 201 and the advance chambers 202, and the connection of the retard chambers 201 to the oil pan 7 and the connection of the advance chambers 202 to the oil pan 7 are blocked to maintain the current phase of the phase converter PC.

In the first operating state, the hydraulic oil is supplied to the retard chambers 201 through the retard supply passage RRs, and the hydraulic oil is returned from the advance chambers 202 to the oil pan 7 through the advance drain passage RAd. In the second operating state, the hydraulic oil is supplied to the advance chambers 202 through the advance supply passage RAs, and the hydraulic oil is returned from the retard chambers 201 to the oil pan 7 through the retard drain passage RRd. In the phase holding state, the hydraulic oil is supplied to the retard chambers 201 and the advance chambers 202 through the retard supply passage RRs and the advance supply passage RAs, and the discharge of the hydraulic oil from the retard chambers 201 and the advance chambers 202 is limited.

The valve timing adjustment device 10 brings the hydraulic oil control valve 11 into the first operating state when the rotational phase of the camshaft 3 is on the advance side of a target value. As a result, the vane rotor 30 undergoes relative rotation in the retarding direction relative to the housing 20, so that the rotational phase of the camshaft 3 shifts to the retard side.

The valve timing adjustment device 10 brings the hydraulic oil control valve 11 into the second operating state when the rotational phase of the camshaft 3 is on the retard side of the target value. As a result, the vane rotor 30 undergoes relative rotation in the advancing direction relative to the housing 20, so that the rotational phase of the camshaft 3 shifts to the advance side.

The valve timing adjustment device 10 brings the hydraulic oil control valve 11 into the phase holding state when the rotational phase of the camshaft 3 coincides with the target value. In this way, the rotational phase of the camshaft 3 is maintained.

Furthermore, in the present embodiment, the hydraulic oil can be supplied to the retard chambers 201 and the advance chambers 202 even when the hydraulic oil control valve 11 is in the phase holding state, i.e., when the current phase of the phase converter PC is maintained. Specifically, at the time of maintaining the current phase of the phase converter PC, it is possible to maintain the supply state of the hydraulic oil to the retard chambers 201 and the advance chambers 202 to limit phase fluctuations of the phase converter PC, which would be caused by the air drawn into the retard chambers 201 and the advance chambers 202.

As described above, according to the present embodiment, there is provided the valve timing adjustment device 10, which adjusts the valve timing of the intake valves 4 of the engine 1 and includes the phase converter PC, the hydraulic oil supply source OS, the hydraulic oil controller OC, the discharge portion OD, the retard supply passage RRs, the advance supply passage RAs, the retard drain passage RRd, the advance drain passage RAd, the retard supply check valve 71 and the advance supply check valve 72.

The phase converter PC has the retard chambers 201 and the advance chambers 202.

The hydraulic oil supply source OS is configured to supply the hydraulic oil to the retard chambers 201 and the advance chambers 202.

The hydraulic oil controller OC is configure to control the hydraulic oil, which is supplied from the oil pump 8 to the retard chambers 201 and the advance chambers 202.

The oil discharge portion OD is configured to receive the hydraulic oil discharged from the retard chambers 201 or the advance chambers 202.

The retard supply passage RRs connects between the hydraulic oil supply source OS and the retard chambers 201 through the hydraulic oil controller OC.

The advance supply passage RAs connects between the hydraulic oil supply source OS and the advance chambers 202 through the hydraulic oil controller OC.

The retard drain passage RRd and the advance drain passage RAd connect the retard chambers 201 and the advance chambers 202 to the oil discharge portion OD.

The retard supply check valve 71 is installed in the retard supply passage RRs and is located on a side of the hydraulic oil controller OC where the hydraulic oil supply source OS is placed. The retard supply check valve 71 enables only a flow of the hydraulic oil from the hydraulic oil supply source OS toward the retard chambers 201.

The advance supply check valve 72 is installed in the advance supply passage RAs and is located on the side of the hydraulic oil controller OC where the hydraulic oil supply source OS is placed. The advance supply check valve 72 enables only a flow of the hydraulic oil from the hydraulic oil supply source OS toward the advance chambers 202.

In the present embodiment, the retard supply check valve 71 and the advance supply check valve 72 are installed at the retard side and the advance side, respectively, so that the back flow of the hydraulic oil toward the hydraulic oil supply source OS is limited, and the hydraulic oil can be supplied to the retard chambers 201 and the advance chambers 202 even in the state where the phase of the phase converter PC is maintained. Specifically, at the time of maintaining the current phase of the phase converter PC, it is possible to maintain the supply state of the hydraulic oil to the retard chambers 201 and the advance chambers 202 to limit phase fluctuations of the phase converter PC, which would be caused by the air drawn into the retard chambers 201 and the advance chambers 202.

Furthermore, in the present embodiment, the retard supply check valve 71 and the advance supply check valve 72 are placed on the upstream side of the hydraulic oil controller OC, i.e., are placed on the hydraulic oil supply source OS side of the hydraulic oil controller OC. Therefore, the oil paths on the downstream side of the hydraulic oil controller OC, i.e., the oil paths between the hydraulic oil controller OC and the retard and advance chambers 201, 202 can be integrated into two systems, i.e., one system for the retard chambers 201 and one system for the advance chambers 202. Thus, the openings formed at the hydraulic oil controller OC for the retard chambers 201 and the advance chambers 202 can be limited to two axial locations, i.e., one axial location where the openings communicated with the retard chambers 201 are provided, and another axial location where the openings communicated with the advance chambers 202 are provided (i.e., the one axial location where the retard openings OR are provided, and the other axial location where the advance openings OA are provided). In this way, the size of the hydraulic oil controller OC, which is measured in the direction, along which the openings are axially arranged one after the other along the hydraulic oil controller OC, can be reduced.

Furthermore, in the present embodiment, the hydraulic oil controller OC includes: the sleeve 400 that is shaped in the tubular form; and the spool 60 that is placed at the inside of the sleeve 400.

The sleeve 400 includes: the retard supply openings ORs that are located in the retard supply passage RRs and are communicated with the hydraulic oil supply source OS; the advance supply openings OAs that are located in the advance supply passage RAs and are communicated with the hydraulic oil supply source OS; the retard openings OR that are located in the retard supply passage RRs and are communicated with the retard chambers 201; and the advance openings OA that are located in the advance supply passage RAs and are communicated with the advance chambers 202.

As discussed above, in the present embodiment, the openings formed at the hydraulic oil controller OC for the retard chambers 201 and the advance chambers 202 can be limited to the two axial locations, i.e., one axial location where the openings communicated with the retard chambers 201 are provided, and another axial location where the openings communicated with the advance chambers 202 are provided (i.e., the one axial location where the retard openings OR are provided, and the other axial location where the advance openings OA are provided). In this way, the number of the openings axially arranged one after the other at the hydraulic oil controller OC can be reduced, and thereby the size of the hydraulic oil controller OC, which is measured in the direction, along which the openings are axially arranged one after the other along the hydraulic oil controller OC, can be reduced.

Furthermore, in the present embodiment, the drain passage includes: the retard drain passage RRd that connects between the retard chambers 201 and the oil discharge portion OD; and the advance drain passage RAd that connects between the advance chambers 202 and the oil discharge portion OD.

The spool 60 has the stroke range that is the range, in which the spool 60 is movable relative to the sleeve 400, while the stroke range includes: the phase holding range, in which the spool 60 closes both of the retard drain passage RRd and the advance drain passage RAd and thereby holds the phase of the phase converter PC; and the advance and retard opening open range, in which the spool 60 opens both of the retard openings OR and the advance openings OA at least in the phase holding range. Therefore, the hydraulic oil can be supplied to both of the retard chambers 201 and the advance chambers 202 at least in the state where the phase of the phase converter PC is maintained. In this way, the phase fluctuations of the phase converter PC, which would be caused by the air drawn into the retard chambers 201 and the advance chambers 202, can be further effectively limited.

Furthermore, in the present embodiment, the stroke range of the spool 60 includes: the advance supply drain range, in which the spool 60 communicates between the advance supply openings OAs and the advance drain passage RAd; and the retard supply drain range, in which the spool 60 communicates between the retard supply opening ORs and the retard drain passage RRd. Therefore, an entire extent of the phase holding range can be made as the advance and retard opening open range. In this way, the hydraulic oil can be always supplied to both of the retard chambers 201 and the advance chambers 202 at the time of closing the retard drain passage RRd and the advance drain passage RAd to maintain the phase of the phase converter PC. Thus, the phase fluctuations of the phase converter PC can be further effectively limited.

Furthermore, in the present embodiment, the sleeve 400 includes: the outer sleeve 40; and the inner sleeve 50 that is placed at the inside of the outer sleeve 40.

The retard supply passage RRs, which connects between the hydraulic oil supply source OS and the retard supply openings ORs, and the advance supply passage RAs, which connects between the hydraulic oil supply source OS and the advance supply openings OAs, are located at the interface T1 between the outer sleeve 40 and the inner sleeve 50. As a result, the retard supply passage RRs and the advance supply passage RAs can be easily formed at the inside of the sleeve 400.

Furthermore, in the present embodiment, the retard supply check valve 71 and the advance supply check valve 72 are placed at the inside of the hydraulic oil controller OC. Therefore, the retard supply passage RRs and the advance supply passage RAs can be branched at the inside of the hydraulic oil controller OC to reduce the number of the openings formed at the hydraulic oil controller OC. Furthermore, the entire size of the valve timing adjustment device 10 can be reduced by placing the retard supply check valve 71 and the advance supply check valve 72 at the inside of the hydraulic oil controller OC.

Furthermore, in the present embodiment, the retard supply check valve 71 and the advance supply check valve 72 are resiliently deformable in the radial direction. Thereby, the configuration of the retard supply check valve 71 and the configuration of the advance supply check valve 72 can be simplified, and the retard supply check valve 71 and the advance supply check valve 72 can be respectively placed at the small space. Thus, the pressure loss of the hydraulic oil can be reduced.

Furthermore, in the present embodiment, the sleeve 400 includes the limiting grooves 511, 512 that are recessed in the radial direction and are respectively configured to limit the movement of the retard supply check valve 71 and the movement of the advance supply check valve 72 in the axial direction.

The retard supply openings ORs and the advance supply openings OAs are localized only in the predetermined fraction of the circumferential extent of the sleeve 400. Thus, when the hydraulic oil flows from the retard supply openings ORs toward the limiting groove 511, the retard supply check valve 71 is urged by the hydraulic oil against the side of the limiting groove 511 that is diametrically opposite to the retard supply openings ORs. In this way, removal of the retard supply check valve 71 from the limiting groove 511 can be limited. Furthermore, when the hydraulic oil flows from the advance supply openings OAs toward the limiting groove 512, the advance supply check valve 72 is urged by the hydraulic oil against the side of the limiting groove 512 that is diametrically opposite to the advance supply openings OAs. In this way, removal of the advance supply check valve 72 from the limiting groove 512 can be limited. Thereby, the limiting grooves 511, 512 can thus maintain the function of limiting the axial movement of the retard supply check valve 71 and the advance supply check valve 72.

Furthermore, the present embodiment is provided with the housing 20.

The housing 20 forms the retard chambers 201 and the advance chambers 202. Specifically, the housing 20 forms the portion of the phase converter PC.

The hydraulic oil controller OC is placed such that at least the portion of the hydraulic oil controller OC is placed at the inside of the housing 20. As a result, the phase converter PC and the hydraulic oil controller OC can be provided integrally. Thereby, it is possible to limit the pressure loss of the hydraulic oil in the path from the hydraulic oil controller OC to the phase converter PC, and it is possible to reduce the size of the valve timing adjustment device 10.

Second Embodiment

A valve timing adjustment device according to a second embodiment will be described with reference to FIG. 13. In the second embodiment, although the physical structure is substantially the same as that of the first embodiment, the way of communicating the respective corresponding passage in response to the stroke of the spool 60 is different from that of the first embodiment.

Figure 13:
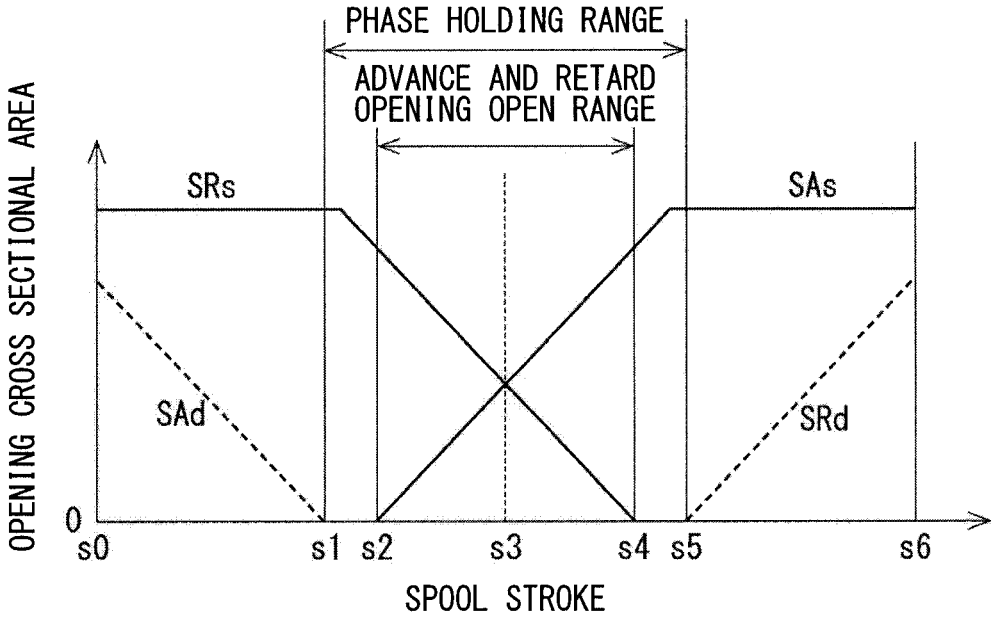
FIG. 13 is a diagram indicating a relationship between a position of a spool and an opening cross-sectional area of each corresponding passage at a valve timing adjustment device of a second embodiment.

As shown in FIG. 13, in a range, which is from the spool stroke s1 to the spool stroke s5, the opening cross-sectional area SAd and the opening cross-sectional area SRd are zero. At this time, the spool 60 closes both of the retard drain passage RRd and the advance drain passage RAd to hold the phase of the phase converter PC. The stroke range of the spool 60 at this time is defined as a phase holding range.

Furthermore, in a range, which is from the spool stroke s2 to the spool stroke s4, the opening cross-sectional area SRs and the opening cross-sectional area SAs are larger than zero. At this time, the spool 60 opens both of the retard openings OR and the advance openings OA to enable the supply of the hydraulic oil to both of the retard chambers 201 and the advance chambers 202. The stroke range of the spool 60 at this time is defined as an advance and retard opening open range (an open range of the advance and retard openings).

As discussed above, in the present embodiment, the spool 60 has the stroke range (s0-s6) that is a range, in which the spool 60 is movable relative to the sleeve 400, while the stroke range (s0-s6) includes: the phase holding range (s1-s5), in which the spool 60 closes both of the retard drain passage RRd and the advance drain passage RAd and thereby to hold the phase of the phase converter PC; and the advance and retard opening open range (s2-s4), in which the spool 60 opens both of the retard openings OR and the advance openings OA at least in the phase holding range.

A length of the advance and retard opening open range (s2-s4) is set to be shorter than a length of the phase holding range (s1-s5).

Other than the points described above, the structure of the second embodiment is the same as that of the first embodiment.

As described above, in the present embodiment, the length of the advance and retard opening open range is set to be shorter than the length of the phase holding range. Therefore, it is possible to limit communication of the retard supply passage RRs or the advance supply passage RAs to the retard drain passage RRd or the advance drain passage RAd and thereby to limit an increase in the amount of leakage of the hydraulic oil toward the oil pan 7.

Third Embodiment

Figure 14:
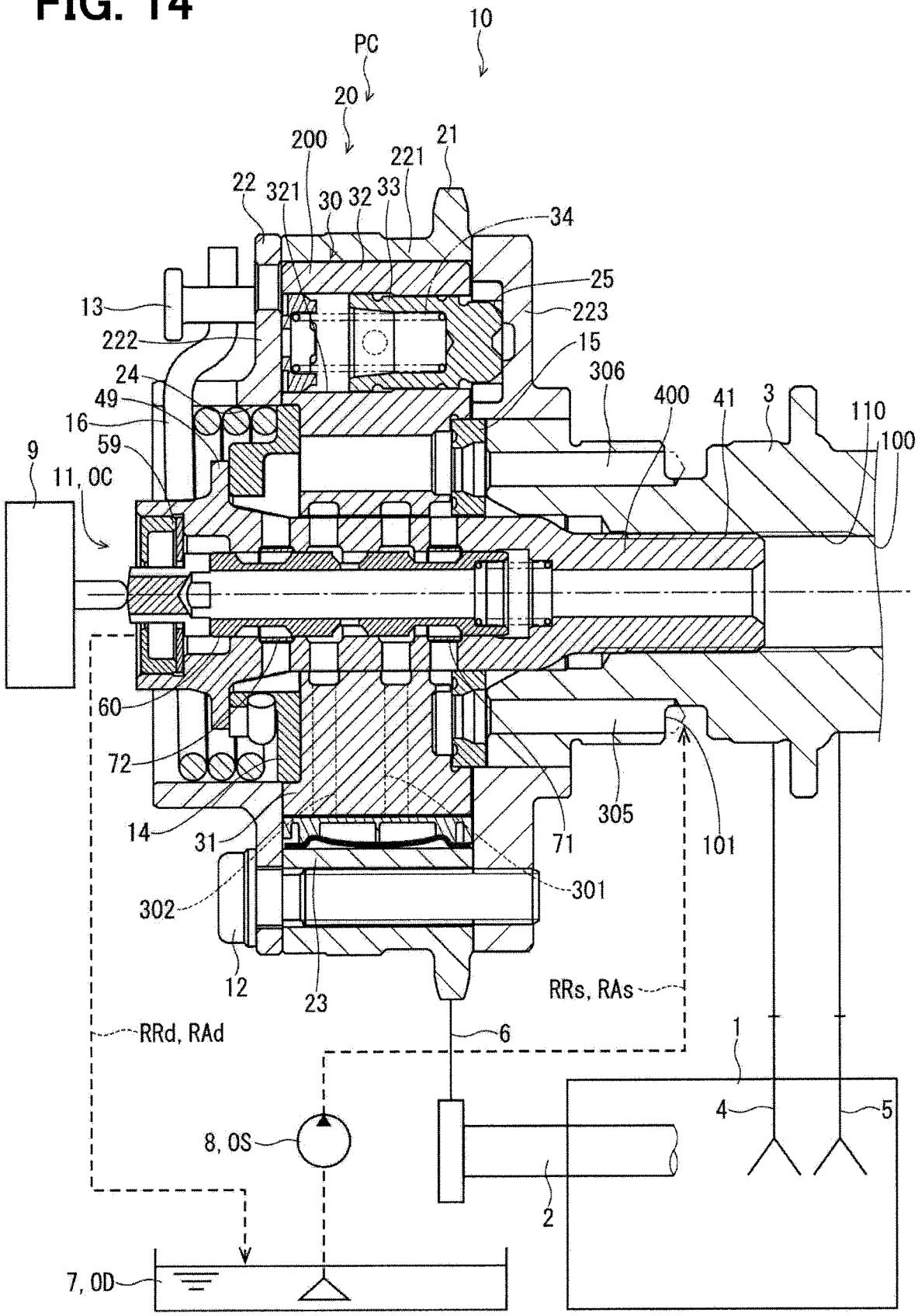
FIG. 14 is a cross-sectional view illustrating a valve timing adjustment device according to a third embodiment.

FIG. 14 illustrates a valve timing adjustment device according to a third embodiment. The third embodiment is different from the first embodiment with respect to the configuration of the hydraulic oil control valve 11.

In the third embodiment, the tubular portion 221 of the case 22 is formed separately from the plate portion 222 of the case 22. The gear portion 21 is placed on the radially outer side of the end portion of the tubular portion 221 placed on the plate portion 223 side such that the gear portion 21 is formed integrally with the tubular portion 221. The fitting recess 25 is formed at the plate portion 223 on the vane rotor 30 side of the plate portion 223. The spring 34 urges the lock pin 33 toward the plate portion 223.

The present embodiment is further provided with an engaging pin 13, a bush 14, an intermediate member 15 and a retard spring 16.

The engaging pin 13 is placed at an outer periphery of the plate portion 222 such that the engaging pin 13 projects from the plate portion 222 toward the side that is opposite to the tubular portion 221. The bush 14 is shaped in a ring form and is placed such that the bush 14 is clamped between the vane rotor 30 and the retaining portion 49 of the sleeve 400. The intermediate member 15 is shaped in a ring form and is placed such that the intermediate member 15 is clamped between the vane rotor 30 and the camshaft 3.

The retard spring 16 is shaped in a coil form and is formed by winding a wire that is made of metal, such as iron or stainless steel. One end portion of the retard spring 16 is engaged with the engaging pin 13, and the other end portion of the retard spring 16 is engaged with the bush 14. The retard spring 16 urges the vane rotor 30 in the advancing direction relative to the housing 20. Here, an urging force of the retard spring 16 is set to be larger than an average value of fluctuating torque (the retarding direction) that is exerted from the camshaft 3 to the vane rotor 30 at the time of rotating the camshaft 3. Thus, in a state where the hydraulic oil is not supplied to the respective retard chambers 201 and the respective advance chambers 202, the vane rotor 30 is urged to the most advanced position in the advancing direction by the retard spring 16.

Figure 15:
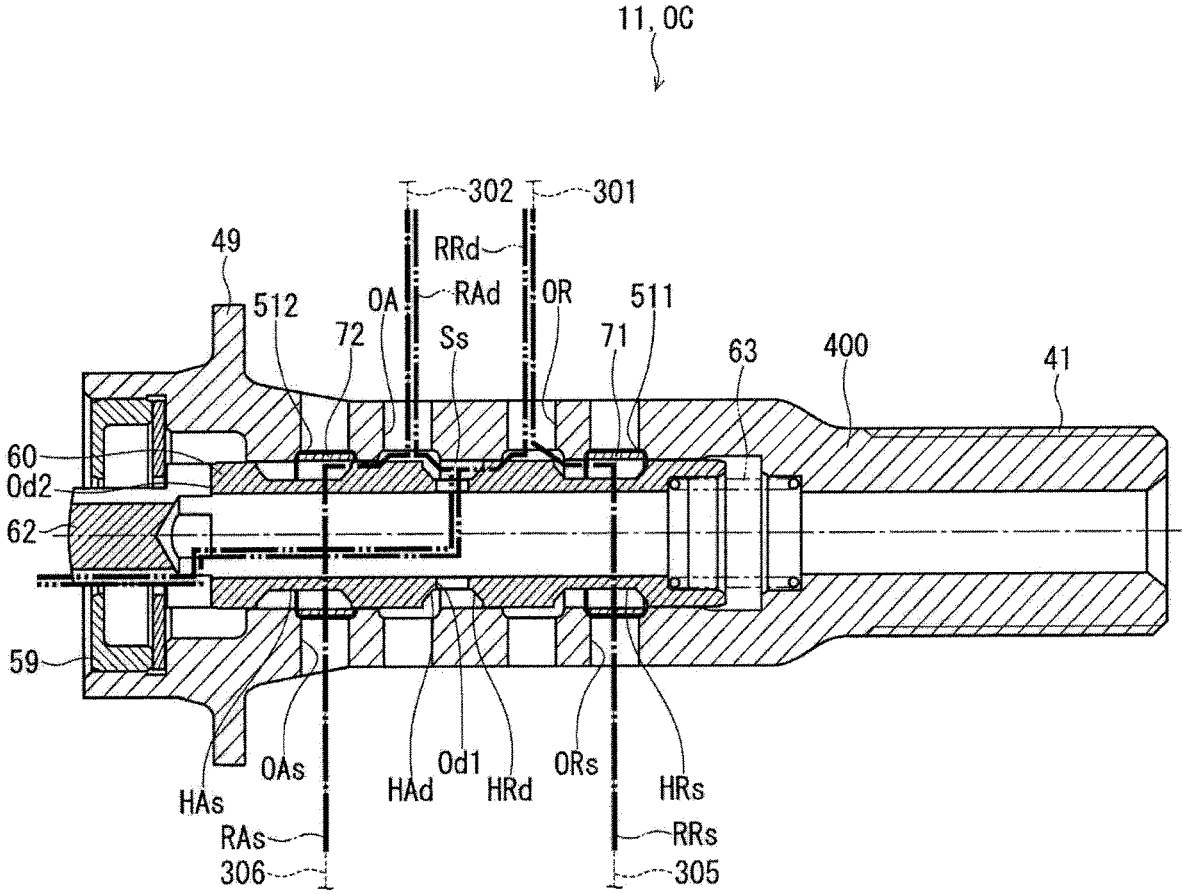
FIG. 15 is a cross-sectional view illustrating a hydraulic oil control valve of the valve timing adjustment device according to the third embodiment.

As shown in FIG. 15, in the third embodiment, the sleeve 400 is not divided into the outer sleeve 40 and the inner sleeve 50 unlike the first embodiment and is formed as a single tubular member.

Each of a plurality of retard supply opening ORs extends in the radial direction of the sleeve 400 and connects the limiting groove 511 of the sleeve 400 to the space at the outside of the sleeve 400. The plurality of retard supply openings ORs is arranged one after the other in the circumferential direction of the sleeve 400. The retard supply openings ORs are connected to the oil pump 8 through a retard passage 305 formed at the camshaft 3, the intermediate member 15 and the vane rotor 30.

Each of a plurality of advance supply openings OAs extends in the radial direction of the sleeve 400 and connects the limiting groove 512 of the sleeve 400 to the space at the outside of the sleeve 400. The plurality of advance supply openings OAs is arranged one after the other in the circumferential direction of the sleeve 400. The advance supply openings OAs are connected to the oil pump 8 through an advance passage 306 that is formed at the camshaft 3, the intermediate member 15, the vane rotor 30 and the bush 14.

Each of a plurality of retard openings OR extends in the radial direction of the sleeve 400 and connects the space, which is located at the inside of the sleeve 400, to the space, which is located at the outside of the sleeve 400. The plurality of the retard openings OR is arranged one after the other in the circumferential direction of the sleeve 400. The retard openings OR are communicated with the retard chambers 201 through the retard passages 301 formed at the vane rotor 30.

Each of a plurality of advance openings OA extends in the radial direction of the sleeve 400 and connects the space, which is located at the inside of the sleeve 400, to the space, which is located at the outside of the sleeve 400. The plurality of the advance openings OA is arranged one after the other in the circumferential direction of the sleeve 400. The advance openings OA are communicated with the advance chambers 202 through the advance passages 302 formed at the vane rotor 30.

The retard supply passage RRs connects between the oil pump 8 and the retard chambers 201 through the supply hole 101, the retard passage 305, the retard supply openings ORs, the limiting groove 511, the retard supply recess HRs, the retard openings OR and the retard passages 301.

The advance supply passage RAs connects between the oil pump 8 and the advance chambers 202 through the supply hole 101, the advance passage 306, the advance supply openings OAs, the limiting groove 512, the advance supply recess HAs, the advance openings OA and the advance passages 302.

The retard drain passage RRd connects the retard chambers 201 to the oil pan 7 through the retard passages 301, the retard openings OR, the retard drain recess HRd and the drain openings Od1, Od2.

The advance drain passage RAd connects the advance chambers 202 to the oil pan 7 through the advance passages 302, the advance openings OA, the advance drain recess HAd and the drain openings Od1, Od2.

As discussed above, in the present embodiment, the retard supply passage RRs, which connects between the oil pump 8 and the retard supply openings ORs, and the advance supply passage RAs, which is placed at the location different from the location of the retard supply passage RRs and connects between the oil pump 8 and the advance supply openings OAs, are formed at the sleeve 400. Furthermore, a portion of each of the retard supply passage RRs, the advance supply passage RAs, the retard drain passage RRd and the advance drain passage RAd is formed at the inside of the hydraulic oil control valve 11.

The retard supply check valve 71 is installed in the limiting groove 511. Specifically, similar to the first embodiment, the retard supply check valve 71 is located on the oil pump 8 side of the spool 60 of the hydraulic oil control valve 11 in the retard supply passage RRs, and the retard supply check valve 71 enables only the flow of the hydraulic oil from the oil pump 8 side toward the retard chambers 201.

The advance supply check valve 72 is installed in the limiting groove 512. Specifically, similar to the first embodiment, the advance supply check valve 72 is located on the oil pump 8 side of the spool 60 of the hydraulic oil control valve 11 in the advance supply passage RAs, and the advance supply check valve 72 enables only the flow of the hydraulic oil from the oil pump 8 side toward the advance chambers 202.

In the third embodiment, the sleeve 400 does not have the sleeve sealing portion 51. Furthermore, the shaft hole 100 is opened to the atmosphere. Therefore, the variable volume space Sv is opened to the atmosphere through the drain openings Od2 and the shaft hole 100.

Other than the points described above, the structure of the third embodiment is similar to the structure of the first embodiment.

As discussed above, in the present embodiment, the retard supply passage RRs, which connects between the hydraulic oil supply source OS and the retard supply openings ORs, and the advance supply passage RAs, which is placed at the location different from the location of the retard supply passage RRs and connects between the hydraulic oil supply source OS and the advance supply openings OAs, are formed at the sleeve 400. Therefore, the retard supply passage RRs and the advance supply passage RAs can be formed at the sleeve 400 without dividing the sleeve 400 into the outer sleeve 40 and the inner sleeve 50 unlike the first embodiment. In this way, the number of the components can be reduced.

Fourth Embodiment

Figure 16:
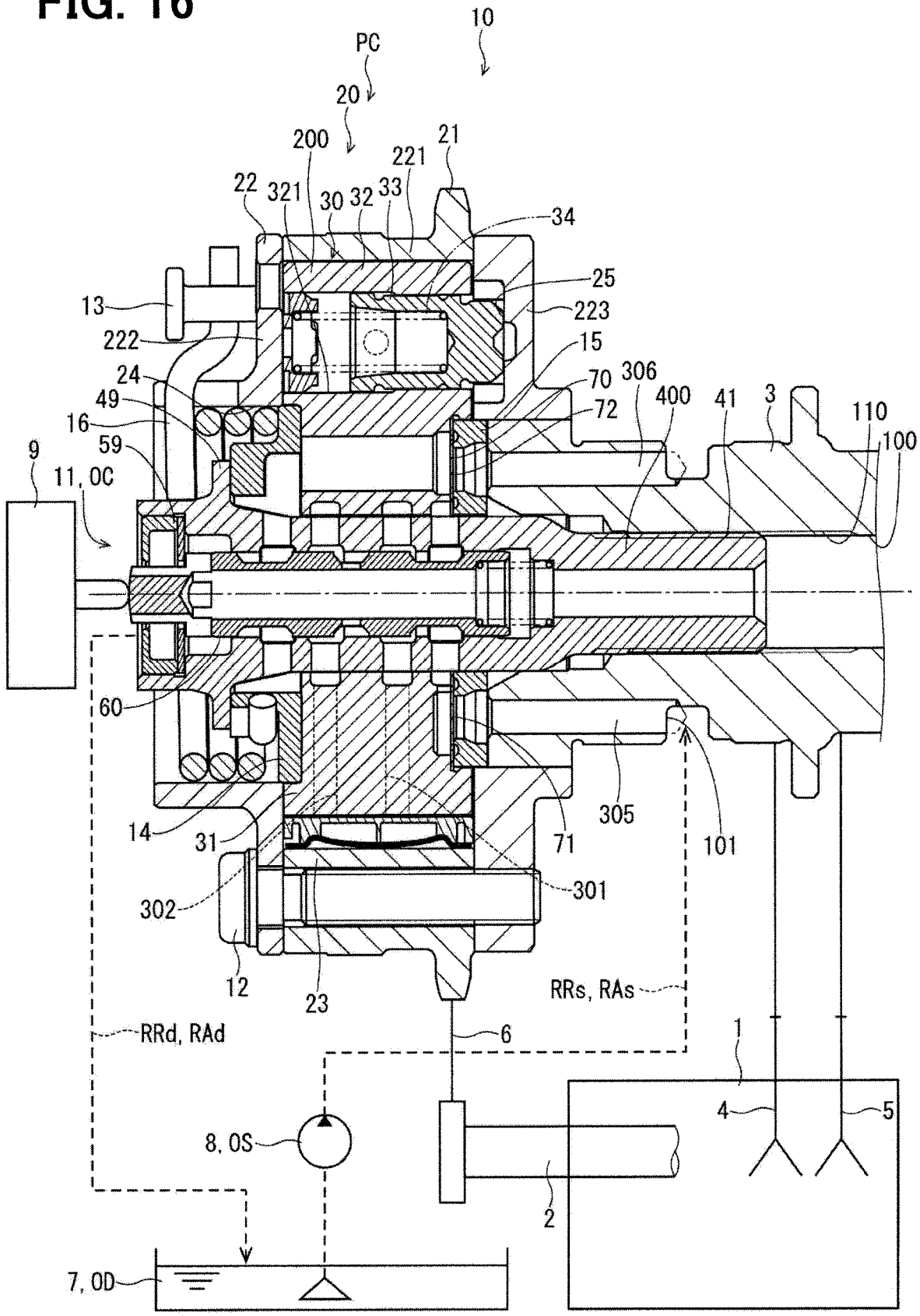
FIG. 16 is a cross-sectional view illustrating a valve timing adjustment device according to a fourth embodiment.

FIG. 16 illustrates a valve timing adjustment device according to a fourth embodiment. In the fourth embodiment, the configuration of the retard supply check valve 71 and the configuration of the advance supply check valve 72 are different from those of the third embodiment.

The fourth embodiment is provided with a reed valve 70.

Figure 17:
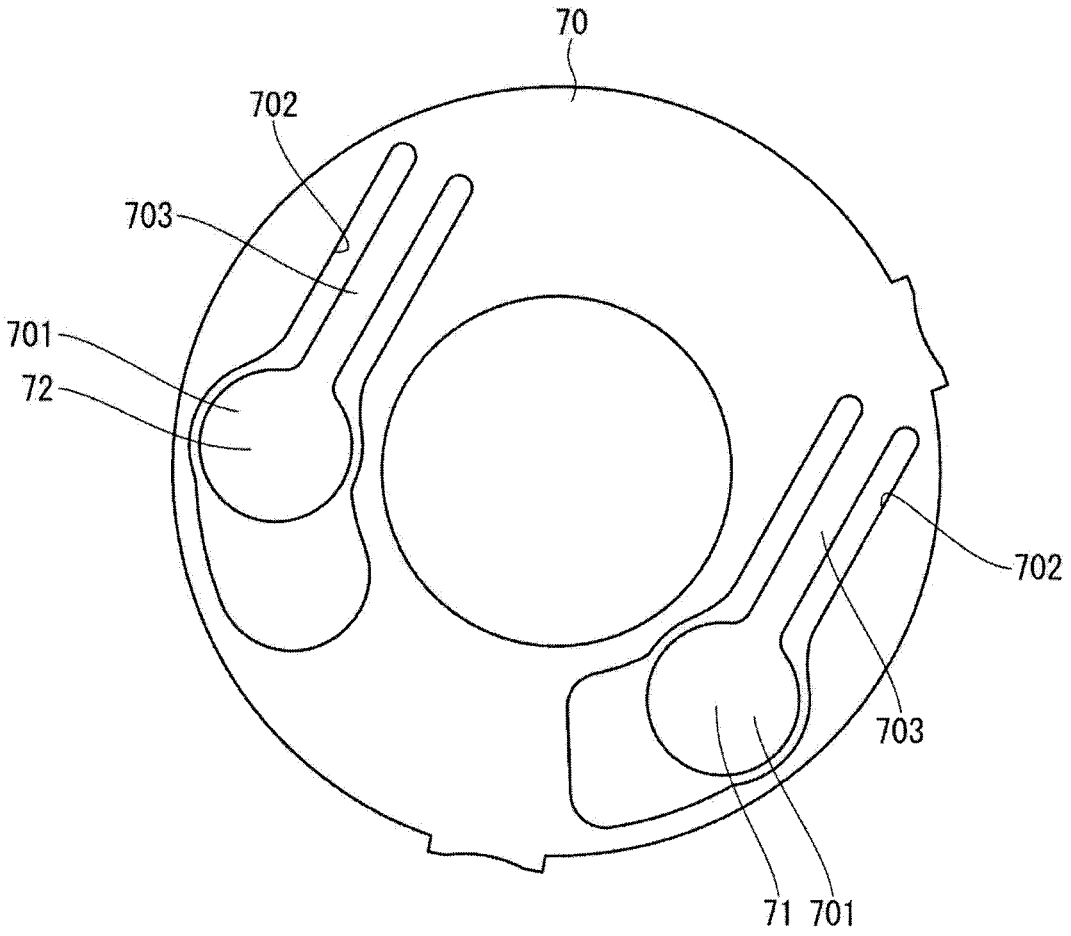
FIG. 17 is a plan view illustrating a reed valve of the valve timing adjustment device according to the fourth embodiment.

As illustrated in FIG. 17, the reed valve 70 is shaped in an annular form and is made of, for example, a metal thin plate. The reed valve 70 includes two openings 702, two support portions 703 and two valve portions 701.

Each opening 702 is formed to extend through the reed valve 70 in a plate thickness direction of the reed valve 70. Each support portion 703 is formed to extend from an inner edge part of the corresponding opening 702 toward a center of the opening 702. Each valve portion 701 is shaped in a circular form. The valve portion 701 is formed integrally with the corresponding support portion 703 such that the valve portion 701 is connected to a distal end part of the support portion 703. The support portion 703 supports the valve portion 701. In the reed valve 70, the valve portions 701 and the support portions 703 are resiliently deformable.

One of the two valve portions 701 corresponds to the retard supply check valve 71. The other one of the two valve portions 701 corresponds to the advance supply check valve 72.

The reed valve 70 is installed such that the reed valve 70 is clamped between the vane rotor 30 and the intermediate member 15. Here, the reed valve 70 is formed such that the retard supply check valve 71 corresponds to the retard passage 305, and the advance supply check valve 72 corresponds to the advance passage 306.

Figure 18:
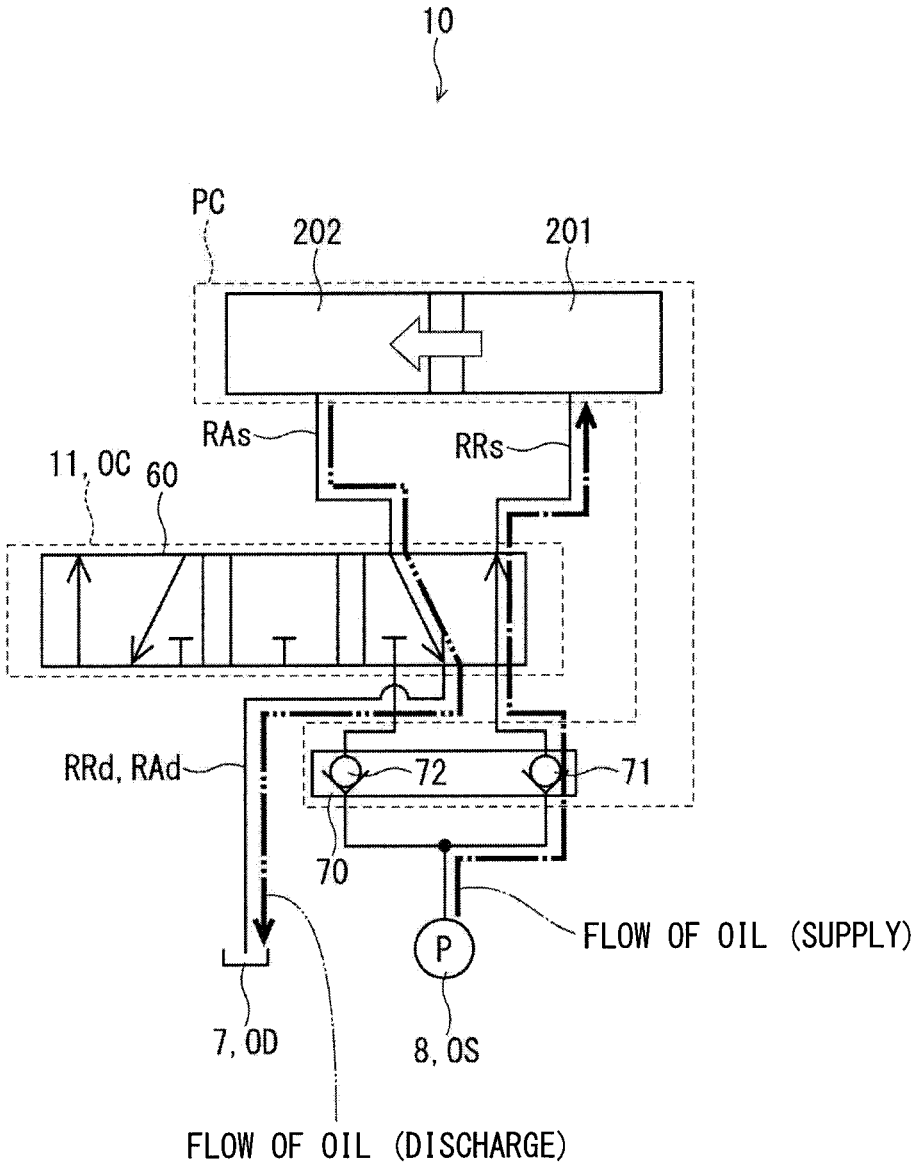
FIG. 18 is a schematic view illustrating the valve timing adjustment device according to the fourth embodiment in a state where a spool is at one end of a stroke range.

As described above, the reed valve 70 is placed at the inside of the housing 20 and is placed at the outside of the hydraulic oil control valve 11 (see FIGS. 16 and 18). The valve portions 701 and the support portions 703 of the reed valve 70 are resiliently deformable, so that the reed valve 70 enables a flow of the hydraulic oil from the oil pump 8 toward the hydraulic oil control valve 11 and blocks a flow of the hydraulic oil from the hydraulic oil control valve 11 toward the oil pump 8. Specifically, the reed valve 70 enables only the flow of the hydraulic oil from the oil pump 8 toward the hydraulic oil control valve 11.

In the present embodiment, the retard supply check valve 71 and the advance supply check valve 72 are not installed at the inside of the hydraulic oil control valve 11 and are formed at the single reed valve 70 that is formed integrally in one piece and is placed at the outside of the hydraulic oil control valve 11 (see FIGS. 16 and 18).

Other than the points described above, the structure of the fourth embodiment is similar to the structure of the third embodiment.

As discussed above, in the present embodiment, the retard supply check valve 71 and the advance supply check valve 72 are placed at the outside of the hydraulic oil controller OC. Therefore, the internal configuration of the hydraulic oil controller OC can be simplified, and the retard supply check valve 71 and the advance supply check valve 72 can be easily installed to the valve timing adjustment device 10.

Furthermore, the present embodiment is provided with the housing 20 and the reed valve 70.

The housing 20 forms the retard chambers 201 and the advance chambers 202. Specifically, the housing 20 forms the portion of the phase converter PC.

The reed valve 70 is placed at the inside of the housing 20 and enables only the flow of the hydraulic oil from the hydraulic oil supply source OS toward the hydraulic oil controller OC.

The reed valve 70 is installed at the inside of the housing 20, so that the reed valve 70 and the housing 20 can be integrally handled.

Furthermore, in the present embodiment, the retard supply check valve 71 and the advance supply check valve 72 are formed in the reed valve 70 that is formed in one piece. Therefore, the number of the components can be reduced.

Fifth Embodiment

Figure 19:
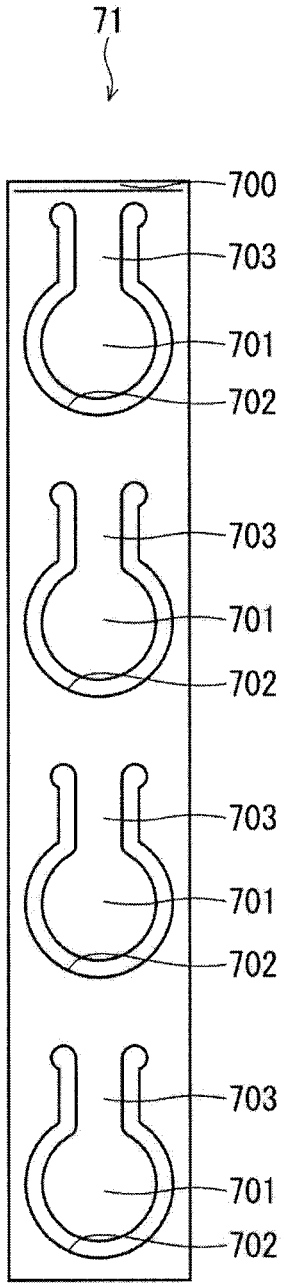
FIG. 19 is a developed view illustrating a retard supply check valve of a valve timing adjustment device according to a fifth embodiment.
Figure 20:
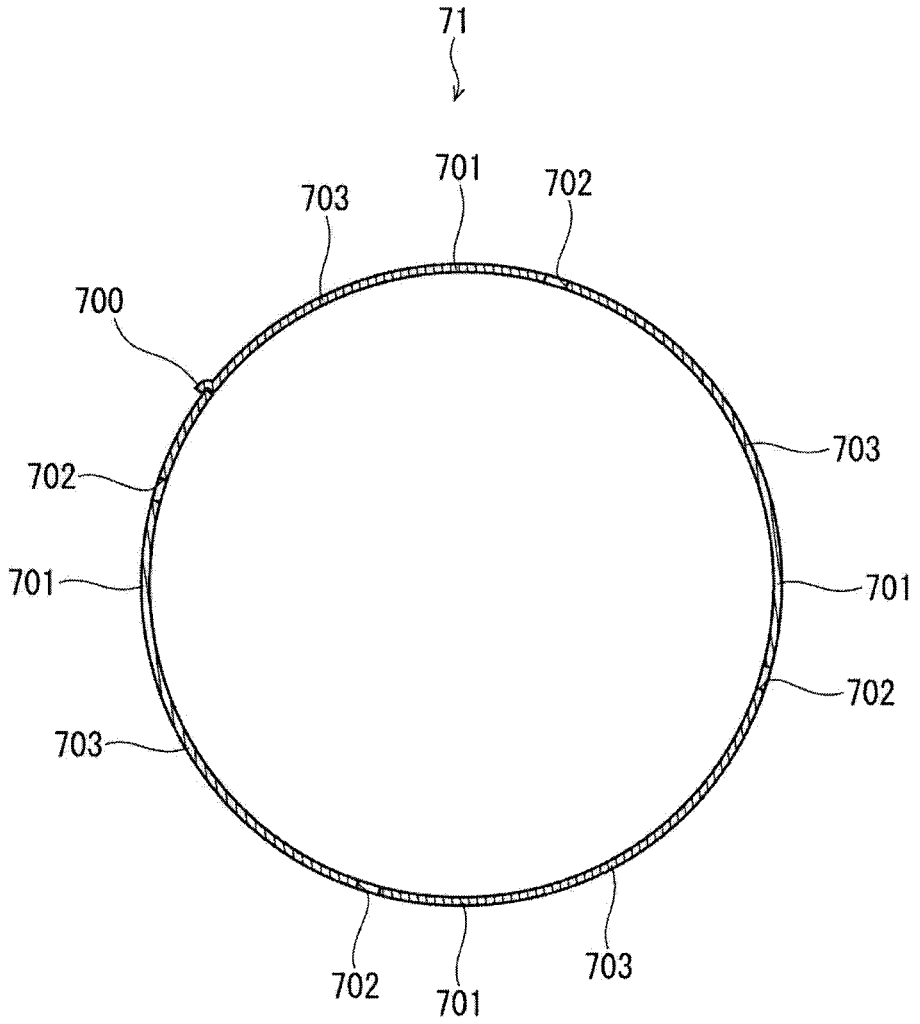
FIG. 20 is a cross-sectional view illustrating the retard supply check valve of the valve timing adjustment device according to the fifth embodiment.

A valve timing adjustment device according to a fifth embodiment will be described with reference to FIGS. 19 and 20. In the fifth embodiment, the configuration of the retard supply check valve 71 and the configuration of the advance supply check valve 72 are different from those of the first embodiment.

Similar to the first embodiment, the retard supply check valve 71 of the fifth embodiment is formed by rolling a rectangular metal thin plate such that a longitudinal direction of the rectangular metal thin plate coincides with the circumferential direction, so that the retard supply check valve 71 is shaped in a substantially cylindrical tubular form. FIG. 19 is a developed view of the retard supply check valve 71. FIG. 20 is a cross-sectional view of the retard supply check valve 71 at an intermediate position thereof in the axial direction.

In the fifth embodiment, the retard supply check valve 71 includes an overlap portion 700, a plurality of openings 702, a plurality of support portions 703, and a plurality of valve portions 701.

The overlap portion 700 is formed at one circumferential end portion of the retard supply check valve 71. The overlap portion 700 is formed to overlap with a radially outer side of the other circumferential end portion of the retard supply check valve 71 (see FIG. 20).

The number of the openings 702 is four, and these openings 702 are arranged one after the other at equal intervals in the circumferential direction of the retard supply check valve 71.

Each of the support portions 703 extends from an inner edge part of a corresponding one of the four openings 702 in the circumferential direction of the retard supply check valve 71.

Each valve portion 701 is connected to a distal end of the corresponding support portion 703. Here, the number of the valve portions 701 is four, and these valve portions 701 are arranged one after the other at equal intervals in the circumferential direction of the retard supply check valve 71.

The retard supply check valve 71 is installed in the limiting groove 511 of the inner sleeve 50. The retard supply check valve 71 is installed such that the support portions 703 and the valve portions 701 are resiliently deformable in the radial direction in the limiting groove 511. Here, the retard supply check valve 71 is formed such that the four valve portions 701 respectively correspond to the four retard supply openings ORs. Specifically, in the present embodiment, the number of the retard supply openings ORs is four, and these four retard supply opening ORs are arranged one after the other in the circumferential direction of the inner sleeve 50.

The structure of the advance supply check valve 72 is similar to that of the retard supply check valve 71, so that the structure of the advance supply check valve 72 will not be described in detail.

The advance supply check valve 72 is installed in the limiting groove 512 of the inner sleeve 50. The advance supply check valve 72 is installed such that the support portions 703 and the valve portions 701 are resiliently deformable in the radial direction in the limiting groove 512. Here, the advance supply check valve 72 is formed such that the four valve portions 701 respectively correspond to the four advance supply openings OAs. Specifically, in the present embodiment, the number of the advance supply openings OAs is four, and these four advance supply openings OAs are arranged one after the other in the circumferential direction of the inner sleeve 50.

Other than the points described above, the structure of the fifth embodiment is similar to the structure of the first embodiment.

Sixth Embodiment

Figure 21:
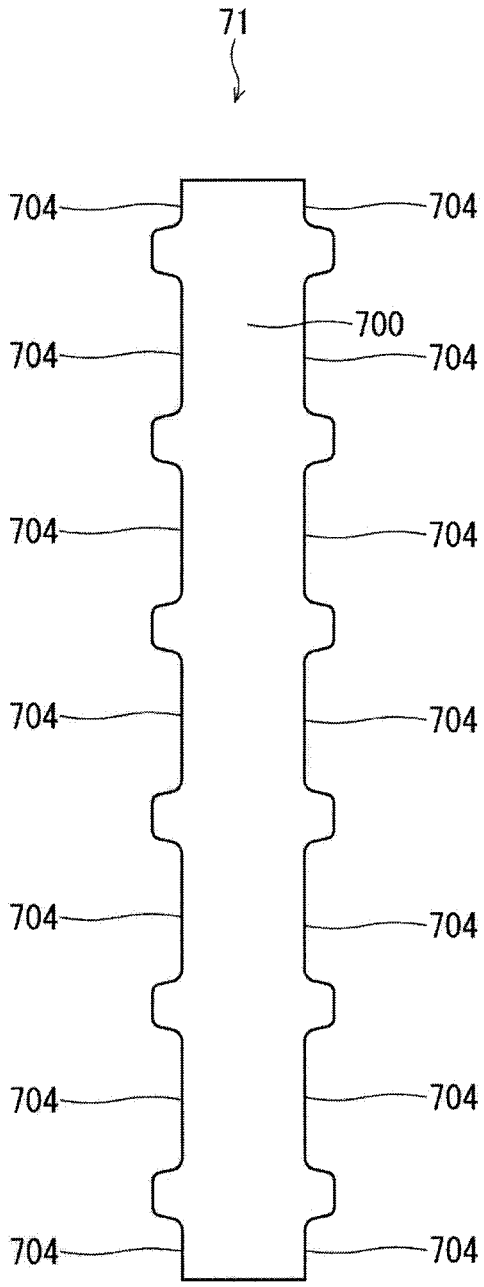
FIG. 21 is a developed view illustrating a retard supply check valve of a valve timing adjustment device according to a sixth embodiment.

A valve timing adjustment device according to a sixth embodiment will be described with reference to FIG. 21. The sixth embodiment is different from the first embodiment with respect to the shape of the retard supply check valve 71 and the advance supply check valve 72.

Similar to the first embodiment, the retard supply check valve 71 of the sixth embodiment is formed by rolling a rectangular metal thin plate such that a longitudinal direction of the rectangular metal thin plate coincides with the circumferential direction, so that the retard supply check valve 71 is shaped in a substantially cylindrical tubular form. FIG. 21 is a developed view of the retard supply check valve 71.

In the sixth embodiment, the retard supply check valve 71 includes the overlap portion 700 and a plurality of cutouts 704.

The overlap portion 700 is formed at one circumferential end portion of the retard supply check valve 71. The overlap portion 700 is formed to overlap with a radially outer side of the other circumferential end portion of the retard supply check valve 71.

The cutouts 704 are formed at two opposite axial end portions of the retard supply check valve 71 by axially cutting the opposite axial end portions of the retard supply check valve 71. The plurality of the cutouts 704 is spaced from each other in the circumferential direction of the retard supply check valve 71.

The retard supply check valve 71 is installed in the limiting groove 511 of the inner sleeve 50. The retard supply check valve 71 is installed such that the retard supply check valve 71 is resiliently deformable in the radial direction in the limiting groove 511.

When the retard supply check valve 71 is radially inwardly deformed or is radially outwardly deformed, the hydraulic oil can flow through the cutouts 704. Therefore, the interference of the radial deformation of the retard supply check valve 71 by the hydraulic oil around the retard supply check valve 71 can be limited. As a result, the smooth operation of the opening/closing valve portions of the retard supply check valve 71 can be promoted.

The structure of the advance supply check valve 72 is similar to that of the retard supply check valve 71, so that the structure of the advance supply check valve 72 will not be described in detail.

The advance supply check valve 72 is installed in the limiting groove 512 of the inner sleeve 50. The advance supply check valve 72 is installed such that the advance supply check valve 72 is resiliently deformable in the radial direction in the limiting groove 512.

When the advance supply check valve 72 is radially inwardly deformed or is radially outwardly deformed, the hydraulic oil can flow through the cutouts 704. Therefore, the interference of the radial deformation of the advance supply check valve 72 by the hydraulic oil around the advance supply check valve 72 can be limited. As a result, the smooth operation of the opening/closing valve portions of the advance supply check valve 72 can be promoted.

Other than the points described above, the structure of the sixth embodiment is similar to that of the first embodiment.

Other Embodiments

In another embodiment of the present disclosure, the locations of the retard supply check valve 71 and the advance supply check valve 72 are not necessary limited within the hydraulic oil controller OC or the housing 20 as long as the retard supply check valve 71 and the advance supply check valve 72 are placed on the hydraulic oil supply source OS side of the hydraulic oil controller OC, i.e., on the upstream side of the hydraulic oil controller OC.

Furthermore, in another embodiment of the present disclosure, the length of the advance and retard opening open range may be set to be the same as the length of the phase holding range.

The above embodiment illustrates the example in which the passage groove 52 (the axial supply passage RsA) is formed at the interface T1 between the outer sleeve 40 and the inner sleeve 50 such that the passage groove 52 (the axial supply passage RsA) is radially inwardly recessed from the outer peripheral wall of the inner sleeve 50. On the other hand, in another embodiment of the present disclosure, the passage groove 52 may be formed at the interface T1 between the outer sleeve 40 and the inner sleeve 50 such that the passage groove 52 is radially outwardly recessed from the inner peripheral wall of the outer sleeve 40.

The first and second embodiments illustrate the example in which the outer sleeve 40 is made of the material containing iron, and the inner sleeve 50 is made of the material containing aluminum. On the other hand, in another embodiment of the present disclosure, the inner sleeve 50 may be made of any other material as long as such a material has the hardness that is lower than the harness of the outer sleeve 40. Furthermore, the outer sleeve 40 may be made of any other material as long as such a material has the hardness that is higher than the hardness of the inner sleeve 50. Moreover, the inner sleeve 50 does not need to be subjected to the surface hardening.

In another embodiment of the present disclosure, the hydraulic oil control valve 11 may be configured such that all parts of the hydraulic oil control valve 11 are located at the outside of the housing 20. In such a case, the threaded portion 41 may be eliminated from the outer sleeve 40. Also in this case, both the outer sleeve 40 and the inner sleeve 50 may be made of a material containing aluminum. In such a case, the material cost of the outer sleeve 40 and the inner sleeve 50 can be reduced while the required strength of the outer sleeve 40 and the inner sleeve 50 is ensured.

Furthermore, in another embodiment of the present disclosure, the housing 20 and the crankshaft 2 may be connected by a transmission member, such as a belt, in place of the chain 6.

The above embodiments illustrate the example in which the vane rotor 30 is fixed to the end portion of the camshaft 3, and the housing 20 is rotated synchronously with the crankshaft 2. Alternatively, in another embodiment of the present disclosure, the vane rotor 30 may be fixed to the end portion of the crankshaft 2, and the housing 20 may be rotated synchronously with the camshaft 3.

The valve timing adjustment device 10 of the present disclosure may adjust the valve timing of the exhaust valves 5 of the engine 1.

As discussed above, the present disclosure is not limited to the above embodiments and can be implemented in various forms without departing from the scope thereof.

The present disclosure has been described with reference to the embodiments. However, the present disclosure should not be limited to the embodiments and the structures described therein. The present disclosure covers various modifications and variations on the scope of equivalents. Also, various combinations and forms as well as other combinations, each of which includes only one element or more or less of the various combinations, are also within the scope and spirit of the present disclosure.

What is claimed is:

1. A valve timing adjustment device configured to adjust a valve timing of a valve of an internal combustion engine, the valve timing adjustment device comprising:

a phase converter that has a retard chamber and an advance chamber;

a hydraulic oil supply source that is configured to supply hydraulic oil to the retard chamber and the advance chamber;

a hydraulic oil controller that is configured to control the hydraulic oil supplied from the hydraulic oil supply source to the retard chamber and the advance chamber and includes a sleeve shaped in a tubular form and a spool placed at an inside of the sleeve;

an oil discharge portion that is configured to receive the hydraulic oil discharged from the retard chamber or the advance chamber;

a retard supply passage that connects between the hydraulic oil supply source and the retard chamber through the hydraulic oil controller;

an advance supply passage that connects between the hydraulic oil supply source and the advance chamber through the hydraulic oil controller;

a drain passage that connects the retard chamber and the advance chamber to the oil discharge portion;

a retard supply check valve that is installed in a portion of the retard supply passage and is located at the hydraulic oil controller or on an upstream side of the hydraulic oil controller in a flow direction of the hydraulic oil fed from the hydraulic oil supply source, wherein the retard supply check valve is configured to open the portion of the retard supply passage to allow a flow of the hydraulic oil from the hydraulic oil supply source toward the retard chamber through the retard supply passage when a pressure of the hydraulic oil on an upstream side of the retard supply check valve is higher than a pressure of the hydraulic oil on a downstream side of the retard supply check valve in the retard supply passage, and the retard supply check valve is also configured to close the portion of the retard supply passage to limit a backflow of the hydraulic oil from the retard chamber toward the hydraulic oil supply source through the retard supply passage when the pressure of the hydraulic oil on the downstream side of the retard supply check valve is higher than the pressure of the hydraulic oil on the upstream side of the retard supply check valve in the retard supply passage; and an advance supply check valve that is installed in a portion of the advance supply passage and is located at the hydraulic oil controller or on the upstream side of the hydraulic oil controller, wherein the advance supply check valve is configured to open the portion of the advance supply passage to allow a flow of the hydraulic oil from the hydraulic oil supply source toward the advance chamber through the advance supply passage when a pressure of the hydraulic oil on an upstream side of the advance supply check valve is higher than a pressure of the hydraulic oil on a downstream side of the advance supply check valve in the advance supply passage, and the advance supply check valve is also configured to close the portion of the advance supply passage to limit a backflow of the hydraulic oil from the advance chamber to the hydraulic oil supply source through the advance supply passage when the pressure of the hydraulic oil on the downstream side of the advance supply check valve is higher than the pressure of the hydraulic oil on the upstream side of the advance supply check valve in the advance supply passage; and the retard chamber is located on one side of a vane of the phase converter in a circumferential direction and is configured to drive the vane in a retarding direction, and the advance chamber is located on another side of the vane in the circumferential direction and is configured to drive the vane in an advancing direction that is opposite to the retarding direction; and the hydraulic oil controller is configured to enable an inflow of the hydraulic oil from the hydraulic oil supply source into the retard chamber through the retard supply check valve along the retard supply passage and an inflow of the hydraulic oil from the hydraulic oil supply source into the advance chamber through the advance supply check valve along the advance supply passage at a time of holding a circumferential position of the vane at a target position.

2. The valve timing adjustment device according to claim 1, wherein:

the sleeve includes:

a retard supply opening that is located in the retard supply passage and is communicated with the hydraulic oil supply source;

an advance supply opening that is located in the advance supply passage and is communicated with the hydraulic oil supply source;

a retard opening that is located in the retard supply passage and is communicated with the retard chamber; and an advance opening that is located in the advance supply passage and is communicated with the advance chamber.

3. The valve timing adjustment device according to claim 2, wherein:

the drain passage includes:

a retard drain passage that connects between the retard chamber and the oil discharge portion; and an advance drain passage that connects between the advance chamber and the oil discharge portion; and the spool has a stroke range that is a range, in which the spool is movable relative to the sleeve, while the stroke range includes:

a phase holding range, in which the spool closes both of the retard drain passage and the advance drain passage and thereby to hold a phase of the phase converter; and an advance and retard opening open range, in which the spool opens both of the retard opening and the advance opening at least in the phase holding range.

4. The valve timing adjustment device according to claim 3, wherein the stroke range of the spool includes:

an advance supply drain range, in which the spool communicates between the advance supply opening and the advance drain passage; or a retard supply drain range, in which the spool communicates between the retard supply opening and the retard drain passage.

5. The valve timing adjustment device according to claim 3, wherein a length of the advance and retard opening open range is set to be longer than a length of the phase holding range.

6. The valve timing adjustment device according to claim 2, wherein:

the sleeve includes:

an outer sleeve; and an inner sleeve that is placed at an inside of the outer sleeve; and the retard supply passage, which connects between the hydraulic oil supply source and the retard supply opening, and the advance supply passage, which connects between the hydraulic oil supply source and the advance supply opening, are located at an interface between the outer sleeve and the inner sleeve.

7. The valve timing adjustment device according to claim 2, wherein the retard supply passage, which connects between the hydraulic oil supply source and the retard opening, and the advance supply passage, which is placed at a location different from a location of the retard supply passage and connects between the hydraulic oil supply source and the advance supply opening, are formed at the sleeve.

8. The valve timing adjustment device according to claim 2, wherein the retard supply check valve and the advance supply check valve are resiliently deformable in a radial direction.

9. The valve timing adjustment device according to claim 8, wherein:

the sleeve includes a plurality of limiting grooves that are recessed in the radial direction and are respectively configured to limit movement of the retard supply check valve and movement of the advance supply check valve in an axial direction;

the retard supply opening is one of a plurality of retard supply openings, and the advance supply opening is one of a plurality of advance supply openings; and the plurality of retard supply openings and the plurality of advance supply openings are localized only in a predetermined fraction of a circumferential extent of the sleeve.

10. The valve timing adjustment device according to claim 1, wherein the retard supply check valve and the advance supply check valve are placed at an inside of the hydraulic oil controller.

11. The valve timing adjustment device according to claim 1, wherein the retard supply check valve and the advance supply check valve are placed at an outside of the hydraulic oil controller.

12. The valve timing adjustment device according to claim 1, further comprising:

a housing that forms the retard chamber and the advance chamber; and a reed valve that is placed at an inside of the housing and enables only a flow of the hydraulic oil from the hydraulic oil supply source toward the hydraulic oil controller, wherein the retard supply check valve and the advance supply check valve are formed at the reed valve that is formed in one piece.

13. The valve timing adjustment device according to claim 1, further comprising a housing that forms the retard chamber and the advance chamber, wherein at least a portion of the hydraulic oil controller is placed at an inside of the housing.

14. The valve timing adjustment device according to claim 1, wherein at a time of holding a phase at the phase converter, the portion of the retard supply passage, in which the retard supply check valve is installed, and the portion of the advance supply passage, in which the advance supply check valve is installed, are respectively communicated with the retard chamber and the advance chamber.

15. A valve timing adjustment device configured to adjust a valve timing of a valve of an internal combustion engine, the valve timing adjustment device comprising:

a phase converter that has a retard chamber and an advance chamber;

a hydraulic oil supply source that is configured to supply hydraulic oil to the retard chamber and the advance chamber;

a hydraulic oil controller that is configured to control the hydraulic oil supplied from the hydraulic oil supply source to the retard chamber and the advance chamber and includes a sleeve shaped in a tubular form and a spool placed at an inside of the sleeve;

an oil discharge portion that is configured to receive the hydraulic oil discharged from the retard chamber or the advance chamber;

a retard supply passage that connects between the hydraulic oil supply source and the retard chamber through the hydraulic oil controller;

an advance supply passage that connects between the hydraulic oil supply source and the advance chamber through the hydraulic oil controller;

a drain passage that connects the retard chamber and the advance chamber to the oil discharge portion;

a retard supply check valve that is installed in a portion of the retard supply passage and is located at the hydraulic oil controller or on an upstream side of the hydraulic oil controller in a flow direction of the hydraulic oil fed from the hydraulic oil supply source, wherein the retard supply check valve is configured to open the portion of the retard supply passage to allow a flow of the hydraulic oil from the hydraulic oil supply source toward the retard chamber through the retard supply passage when a pressure of the hydraulic oil on an upstream side of the retard supply check valve is higher than a pressure of the hydraulic oil on a downstream side of the retard supply check valve in the retard supply passage, and the retard supply check valve is also configured to close the portion of the retard supply passage to limit a backflow of the hydraulic oil from the retard chamber toward the hydraulic oil supply source through the retard supply passage when the pressure of the hydraulic oil on the downstream side of the retard supply check valve is higher than the pressure of the hydraulic oil on the upstream side of the retard supply check valve in the retard supply passage; and an advance supply check valve that is installed in a portion of the advance supply passage and is located at the hydraulic oil controller or on the upstream side of the hydraulic oil controller, wherein the advance supply check valve is configured to open the portion of the advance supply passage to allow a flow of the hydraulic oil from the hydraulic oil supply source toward the advance chamber through the advance supply passage when a pressure of the hydraulic oil on an upstream side of the advance supply check valve is higher than a pressure of the hydraulic oil on a downstream side of the advance supply check valve in the advance supply passage, and the advance supply check valve is also configured to close the portion of the advance supply passage to limit a backflow of the hydraulic oil from the advance chamber to the hydraulic oil supply source through the advance supply passage when the pressure of the hydraulic oil on the downstream side of the advance supply check valve is higher than the pressure of the hydraulic oil on the upstream side of the advance supply check valve in the advance supply passage; wherein:

the drain passage includes:

a retard drain passage that connects between the retard chamber and the oil discharge portion; and an advance drain passage that connects between the advance chamber and the oil discharge portion; and the spool has a stroke range that is a range, in which the spool is movable relative to the sleeve, while the stroke range includes:

a phase holding range, in which the spool closes both of the retard drain passage and the advance drain passage and thereby to hold a phase of the phase converter.

16. The valve timing adjustment device according to claim 15, wherein:

the sleeve includes:

a retard supply opening that is located in the retard supply passage and is communicated with the hydraulic oil supply source;

an advance supply opening that is located in the advance supply passage and is communicated with the hydraulic oil supply source;

a retard opening that is located in the retard supply passage and is communicated with the retard chamber; and an advance opening that is located in the advance supply passage and is communicated with the advance chamber; and the stroke range includes an advance and retard opening open range, in which the spool opens both of the retard opening and the advance opening at least in the phase holding range.

* * * * *